US012629558B2

(12) United States Patent
Vannoni et al.

(10) Patent No.: US 12,629,558 B2
(45) Date of Patent: May 19, 2026

(54) TREADMILL WITH FORCE PLATE

(71) Applicant: TECHNOGYM S.P.A., Cesena (IT)

(72) Inventors: Enrico Vannoni, Cesena (IT); Luca Bandini, Cesena (IT); Luca Zoffoli, Cesena (IT); Alessandro Del Monaco, Cesena (IT)

(73) Assignee: TECHNOGYM S.P.A., Cesena (IT)

( * ) Notice: Subject to any disclaimer, the term of this patent is extended or adjusted under 35 U.S.C. 154(b) by 127 days.

(21) Appl. No.: 18/581,523

(22) Filed: Feb. 20, 2024

(65) Prior Publication Data

US 2024/0278068 A1 Aug. 22, 2024

(30) Foreign Application Priority Data

Feb. 20, 2023 (IT) ..... 102023000002880

(51) Int. Cl.
*A63B 22/02* (2006.01)
*A63B 24/00* (2006.01)

(52) U.S. Cl.
CPC ..... *A63B 22/0285* (2013.01); *A63B 24/0062* (2013.01); *A63B 2220/51* (2013.01); *A63B 2220/58* (2013.01); *A63B 2220/833* (2013.01)

(58) Field of Classification Search
CPC ..... A63B 22/0285; A63B 24/0062; A63B 2220/51; A63B 2220/58; A63B 2220/833; A63B 22/02; A63B 2220/52; A61B 5/112; A61B 5/1123; A61B 2562/0252; A61B 5/11; A61B 5/6895; A61B 5/7275; A61B 5/221
See application file for complete search history.

(56) References Cited

U.S. PATENT DOCUMENTS 4,614,337 A * 9/1986 Schonenberger ..... A63B 22/02 482/54
5,299,454 A * 4/1994 Fuglewicz ..... A61B 5/1038 600/592
9,526,451 B1 12/2016 Berme
11,857,331 B1 * 1/2024 Berme ..... A61B 5/1038
(Continued)

FOREIGN PATENT DOCUMENTS

KR 20180083006 A 7/2018
WO 2018/006055 A1 1/2018

OTHER PUBLICATIONS

Italian Search Report for Italian Patent Application No. 102023000002880 dated Aug. 7, 2023, The Hague, NL.

*Primary Examiner* — Sundhara M Ganesan
(74) *Attorney, Agent, or Firm* — ArentFox Schiff LLP; Michael Fainberg

(57) ABSTRACT

A treadmill is provided which has a first supporting component of a surface of physical exercise of the treadmill and a second supporting component of the surface of physical exercise arranged on a first side of the surface of physical exercise and on a second side of the surface of physical exercise, respectively, parallel to a direction of longitudinal development of a base of the treadmill. The surface of physical exercise is mechanically connected to the first supporting component and to the second supporting component to slide along the direction of longitudinal development of the base of the treadmill. A plurality of load cells is arranged below the first supporting component of the surface of physical exercise and the second supporting component of the surface of physical exercise.

13 Claims, 17 Drawing Sheets

(56) References Cited

U.S. PATENT DOCUMENTS

| | | | | |
|---|---|---|---|---|
| 2021/0187347 | A1* | 6/2021 | Remsberg | A63B 22/02 |
| 2023/0310927 | A1* | 10/2023 | Ota | A63B 22/0285 482/8 |
| 2024/0024735 | A1* | 1/2024 | Rubio | A63B 22/0235 |

* cited by examiner

TREADMILL WITH FORCE PLATE

CROSS-REFERENCE TO RELATED APPLICATION

This application claims priority to Italian Patent Application No. 102023000002880 filed on Feb. 20, 2023, the contents of which are incorporated by reference in their entirety.

FIELD OF THE INVENTION

The present invention relates to the fitness field, and in particular, to a treadmill with force plate.

BACKGROUND OF THE INVENTION

The determination of force values, in particular the constraint reaction force values, generated by a user on a belt of a treadmill, both during movement (running/walking) and in the absence of movement (simple standing) has always been a very important aspect of biomechanics studies.

In this respect, it is known to equip a treadmill with four mutually independent force transducers arranged in an array under the belt to define a so-called force plate.

Each force transducer measures the vertical force applied on a detection area corresponding to the belt zone below which the force transducers are located.

The individual vertical force measurements made by the vertical force transducers can be combined with each other to obtain, from the force plate, information caused by the user's interaction with the treadmill belt, such as the resulting force applied by the user and/or the position of the user's center of pressure, from which other information can be determined, such as the user's stride pace, the user's gait, the distribution of loads, and other biomechanical information.

Nowadays, the need is strongly felt to have a treadmill, even of a type other than of the belt type, equipped with a force plate in which the installation of vertical force transducers is rather simple, unobtrusive while ensuring accuracy and reliability of the determinations to be performed by the force plate.

SUMMARY

It is the object of the present invention to devise and provide a treadmill with force plate alternative to those of the prior art which allows obviating at least partially the drawbacks complained above with reference to the prior art and which, in particular, provides for a rather simple, unobtrusive installation of force transducers (thus of a force plate) while ensuring accuracy and reliability of the determinations to be performed by the force plate.

Such an object is achieved by a treadmill comprising:

a base extending along a respective direction of longitudinal development, the base comprises a first rotating element and a second rotating element adapted to rotate around respective axes of rotation transverse to the direction of longitudinal development of the base of the treadmill, the base further comprising a surface of physical exercise (10) operatively connected to the first rotating element and to the second rotating element, the rotation of the first rotating element and of the second rotating element dragging the surface of physical exercise by rotation along the direction of longitudinal development of the base of the treadmill, the surface of physical exercise having a respective portion facing towards a user during the user's interaction with the surface of physical exercise, the surface of physical exercise comprises a plurality of slats having respective directions of longitudinal development substantially parallel with respect to each other and transverse with respect to the direction of longitudinal development of the base of the treadmill; and a plurality of load cells arranged below the surface of physical exercise, each load cell being arranged below the surface of physical exercise in such a way as to detect data representative of a local force vector along a direction orthogonal to the portion of the surface of physical exercise in correspondence of such load cell due to the user's interaction with the surface of physical exercise, the plurality of load cells including a first pair of load cells and a second pair of load cells arranged in series along the direction of longitudinal development, the plurality of load cells being arranged, parallel to the direction of longitudinal development of the base of the treadmill, in correspondence of a first side of the surface of physical exercise and of a second side of the surface of physical exercise.

The treadmill is characterized by further comprising a first supporting component of the surface of physical exercise and a second supporting component of the surface of physical exercise arranged on the first side of the surface of physical exercise and on the second side of the surface of physical exercise, respectively, parallel to the direction of longitudinal development of the base of the treadmill, the surface of physical exercise being mechanically connected to the first supporting component and to the second supporting component to slide along the direction of longitudinal development of the base of the treadmill, the plurality of load cells being arranged below the first supporting component of the surface of physical exercise and of the second supporting component of the surface of physical exercise.

Preferred embodiments of the treadmill are defined in the dependent claims.

BRIEF DESCRIPTION OF THE DRAWINGS

Further features and advantages of the treadmill according to the invention will become apparent from the following description of preferred embodiments, given by way of non-limiting indication, with reference to the accompanying figures, in which.

It should be noted that, in the aforesaid figures, equivalent or similar elements are indicated by the same numeric and/or alphanumeric reference.

DETAILED DESCRIPTION

Figure 1A:
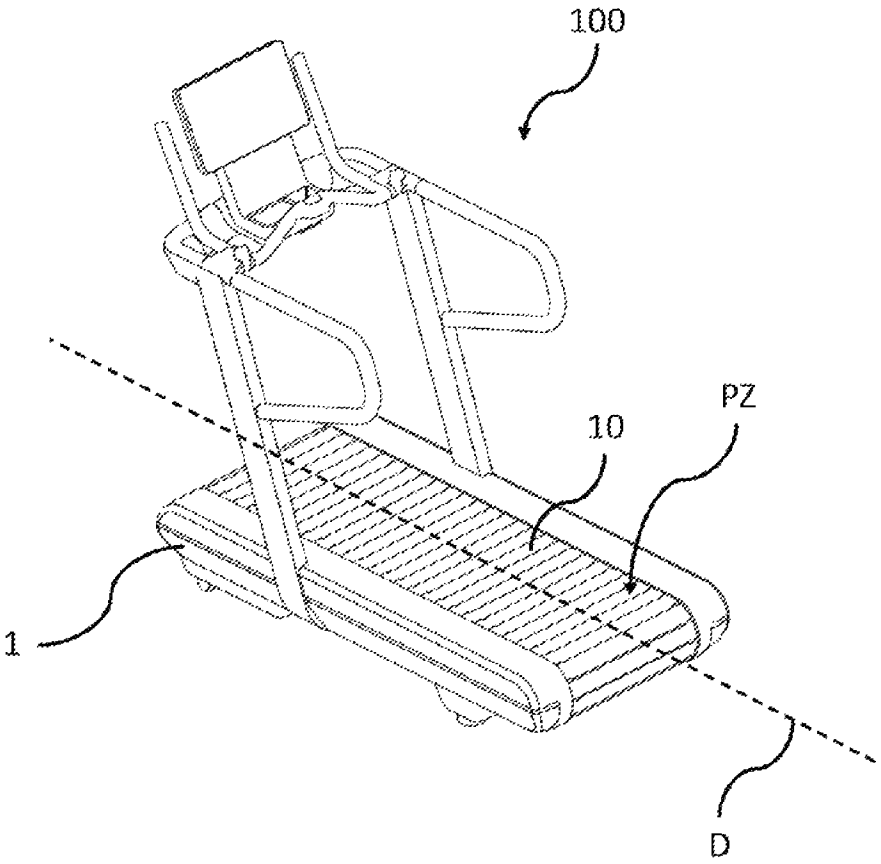
FIG. 1*a* shows an example of a treadmill on which the present invention is implementable.

With reference to the figures, reference numeral 100 indicates as a whole a treadmill adapted to implement a method for determining information representative of a user's interaction with a surface of physical exercise of a treadmill, according to the present invention.

The treadmill 100 comprises a base 1 extending along a respective direction of longitudinal development D, indicated with a dashed line in the figures.

Figure 8:
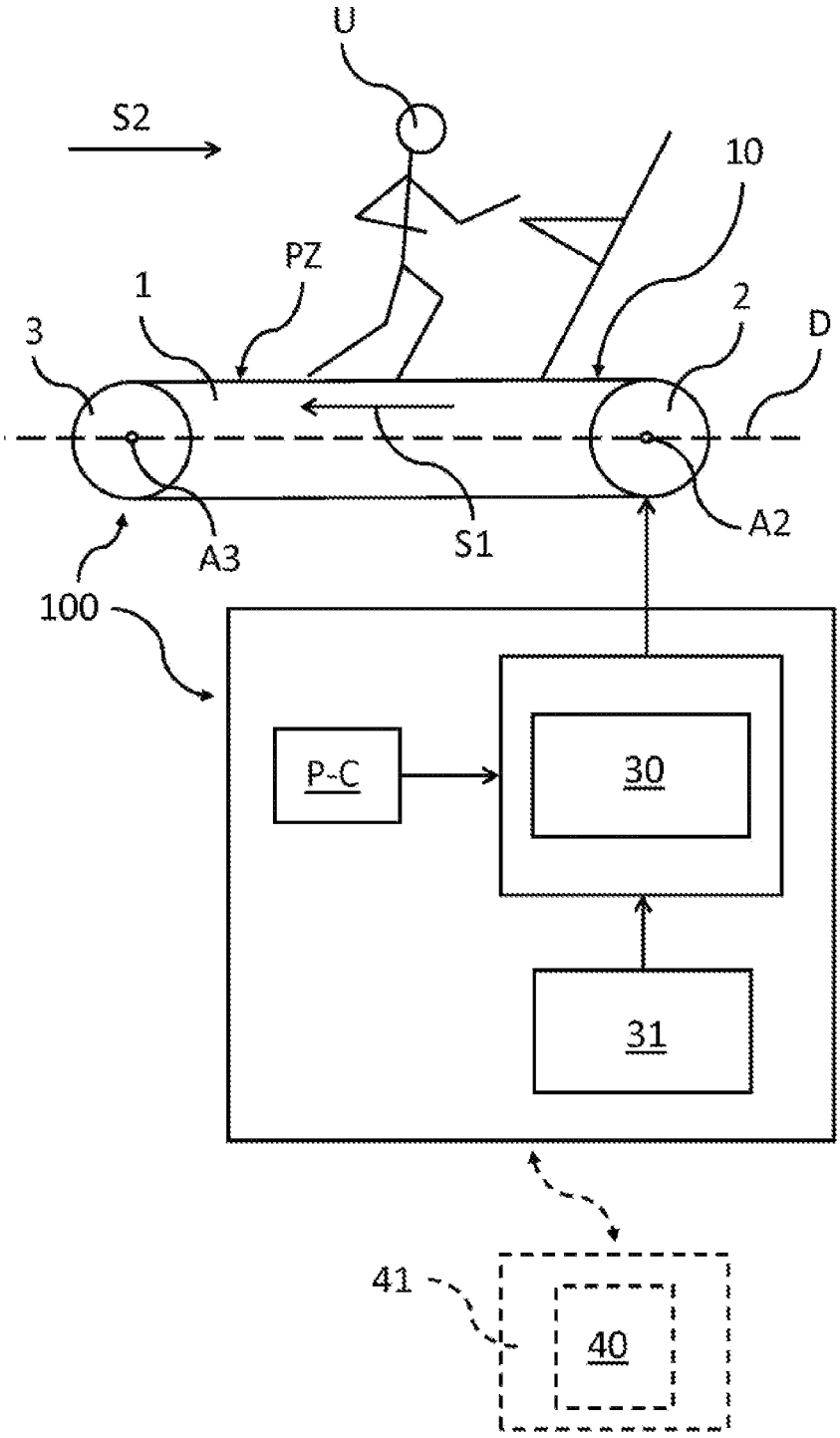
FIG. 8 shows, by means of a block diagram and from a functional point of view, a treadmill according to the present invention, and FIG. 9 show, by means of a block diagram, a method for determining information representative of a user's interaction with a surface of physical exercise of a treadmill according to an embodiment of the present invention.

With particular reference to FIG. 8, the base 1 comprises a first rotating element 2, e.g., a first roll, and a second rotating element 3, e.g., a second roll, adapted to rotate about respective axes of rotation (first axis of rotation A2 for the first rotating element 2, second axis of rotation A3 for the second rotating element 3) transverse to the direction of longitudinal development D of the base 1 of the treadmill 100 (FIGS. 2, 3*a*, 3*c*-3*e*, 4*a*-4*b*).

It should be noted that the first rotating element 2 is arranged at a first end of the base 1, while the second rotating element 3 is arranged at a second end of the base 1, which is located, along the direction of longitudinal development D of the base 1, in the position opposite to the position in which the first end is located.

The base 1 further comprises a surface of physical exercise 10 operatively connected to the first rotating element 2 and to the second rotating element 3.

The rotation of the first rotating element 2 and the second rotating element 3 rotates the surface of physical exercise 10 along the direction of longitudinal development D of the base 1 of the treadmill.

The surface of physical exercise 10 has a respective portion PZ of the surface of physical exercise 10 facing a user U (diagrammatically shown in FIG. 2) during the interaction of the user U with the surface of physical exercise 10.

For the purposes of the present description, "surface of physical exercise" means the rotatable surface of the treadmill 100 on which a user U, by placing his or her feet or lower limbs in general, can carry out a physical exercise, such as running, walking, pushing exercises, pulling exercises or any other type of physical exercise that the treadmill 100 allows.

Moreover, it should be noted that "rotating element" means any mechanical element adapted to rotate about a respective rotation axis so as to impart a rotation to the "surface of physical exercise" operatively associated with one or more of these revolving elements.

The type of rotating elements, some examples of which will be described below, depends on the type of surface of physical exercise to be rotated.

Figure 2:
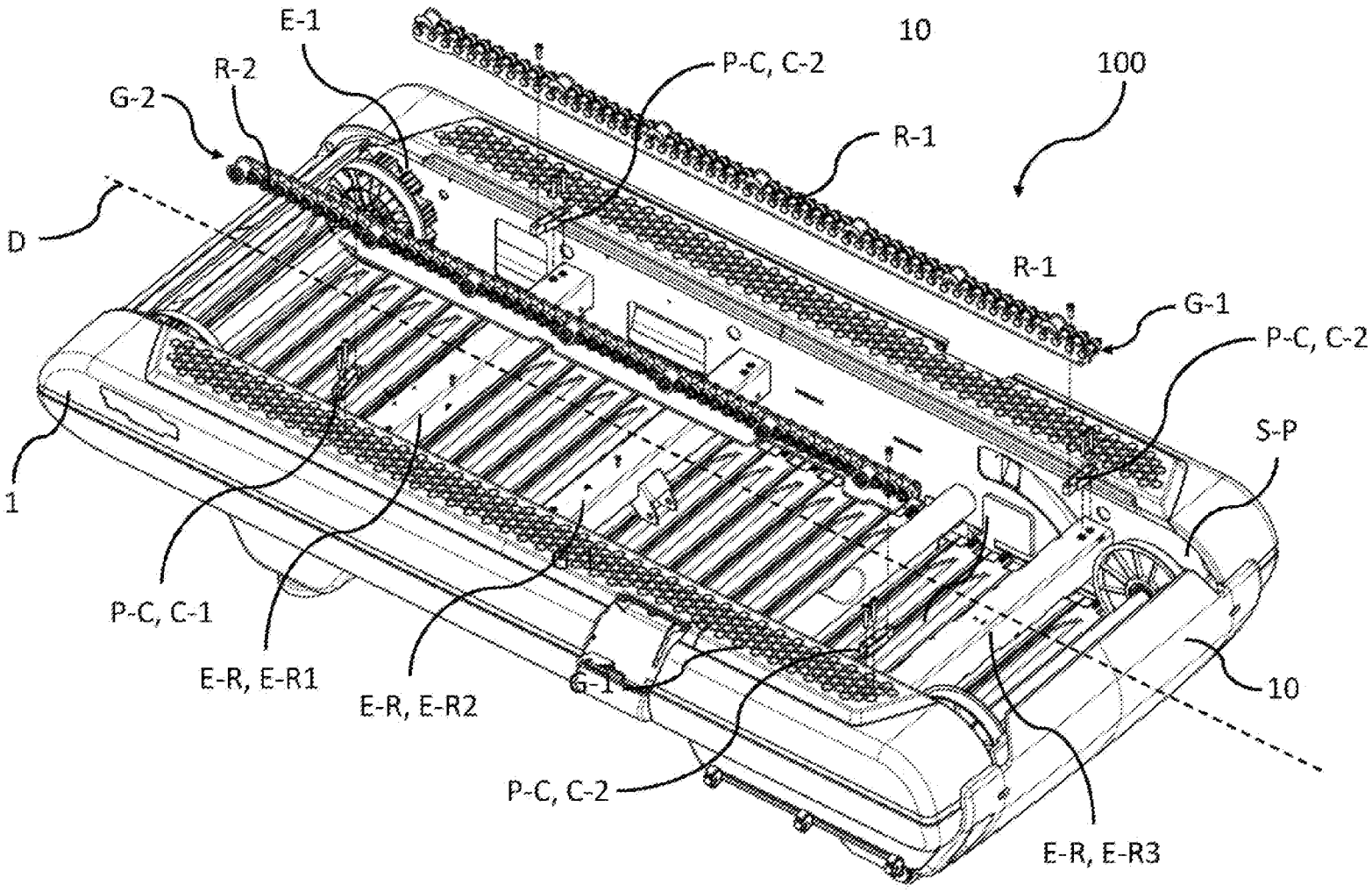
FIG. 2 diagrammatically shows a perspective view of a component of the treadmill in FIG. 1*a*, according to an embodiment of the present invention.

When the surface of physical exercise 10 is moving, the forward movement direction of the surface of physical exercise 10, indicated by reference sign S1 in FIG. 8 (e.g., from right leftwards), is opposite to the forward movement direction of the user U on the surface of physical exercise 10, indicated by reference sign S2 in FIG. 2 (e.g., from the left rightwards).

According to an embodiment, shown in FIGS. 1*a*, 1*b*, 2, 3*a*-3*e* and 4*a*-4*b*, the surface of physical exercise 10 has a side profile substantially parallel to the direction of longitudinal development D of the base 1.

Therefore, in this embodiment, the treadmill 100 is a flat treadmill.

With general reference to FIGS. 2, 3*a*, 3*c*-3*e*, 4*a*-4*b*, the base 1 of the treadmill 100 comprises a supporting structure S-P.

The supporting structure S-P comprises a first supporting element E-1 and a second supporting element E-2 extending along the direction of longitudinal development D of the base 1 of the treadmill 100.

The first supporting element E-1 and the second supporting element E-2 are arranged at a first side of the base 1 of the treadmill 100 and at a second side of the base 1 of the treadmill 100, respectively, parallel to the direction of longitudinal development D of the base 1 of the treadmill 100.

The supporting structure S-P comprises a plurality of connecting elements E-R between the first supporting element E-1 and the second supporting element E-2.

The plurality of connecting elements E-R, e.g., quadrangular section bars, is arranged transversely to the first supporting element E-1 and the second supporting element E-2, then transversely to the direction of longitudinal development D of the base 1 of the treadmill 100.

The two ends of each connecting element of said plurality of connecting elements E-R are fixed, for example by welding, to the first supporting element E-1 and the second supporting element E-2, respectively.

Turning back in general to the treadmill 100 according to the present invention, with particular reference to FIGS. 2, 3*a*-3*e*, 4*a*-4*b*, 5*a*-5*b*, 6*a*-6*b*, and 7*a*-7*b*, the treadmill 100 comprises a plurality P-C of load cells.

Each load cell of said plurality is arranged under the surface of physical exercise 10 so as to detect data representative of a local force vector along a direction orthogonal to the portion PZ of the surface of physical exercise 10 at such a load cell due to the interaction of the user U with the surface of physical exercise 10.

For the purposes of the present description, "data representative of a respective local force vector" means the orientation along the direction orthogonal to the portion PZ of the surface of physical exercise 10 and/or the magnitude representing the intensity or amplitude of the local force vector.

Figure 5A:
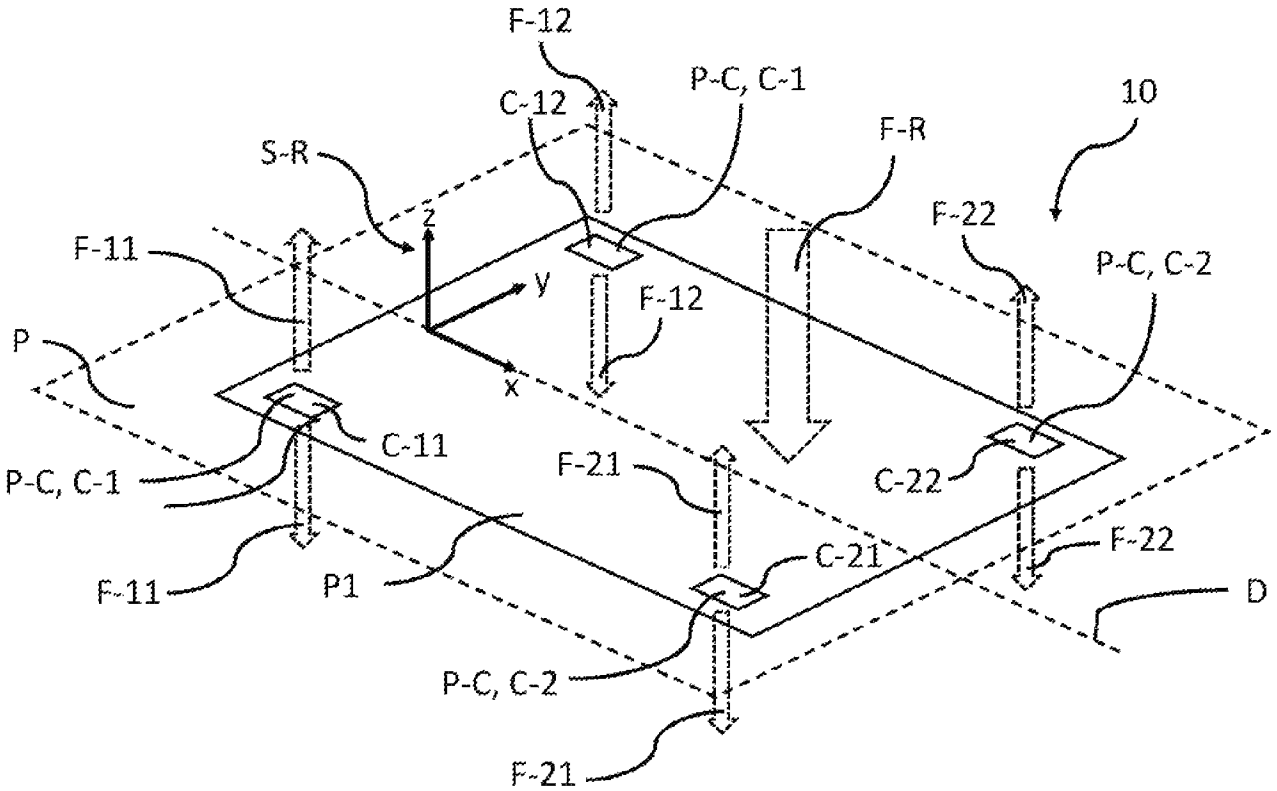
FIG. 5*a* diagrammatically shows a perspective view of a surface of physical exercise of a treadmill according to the embodiment in FIG. 2.
Figure 5B:
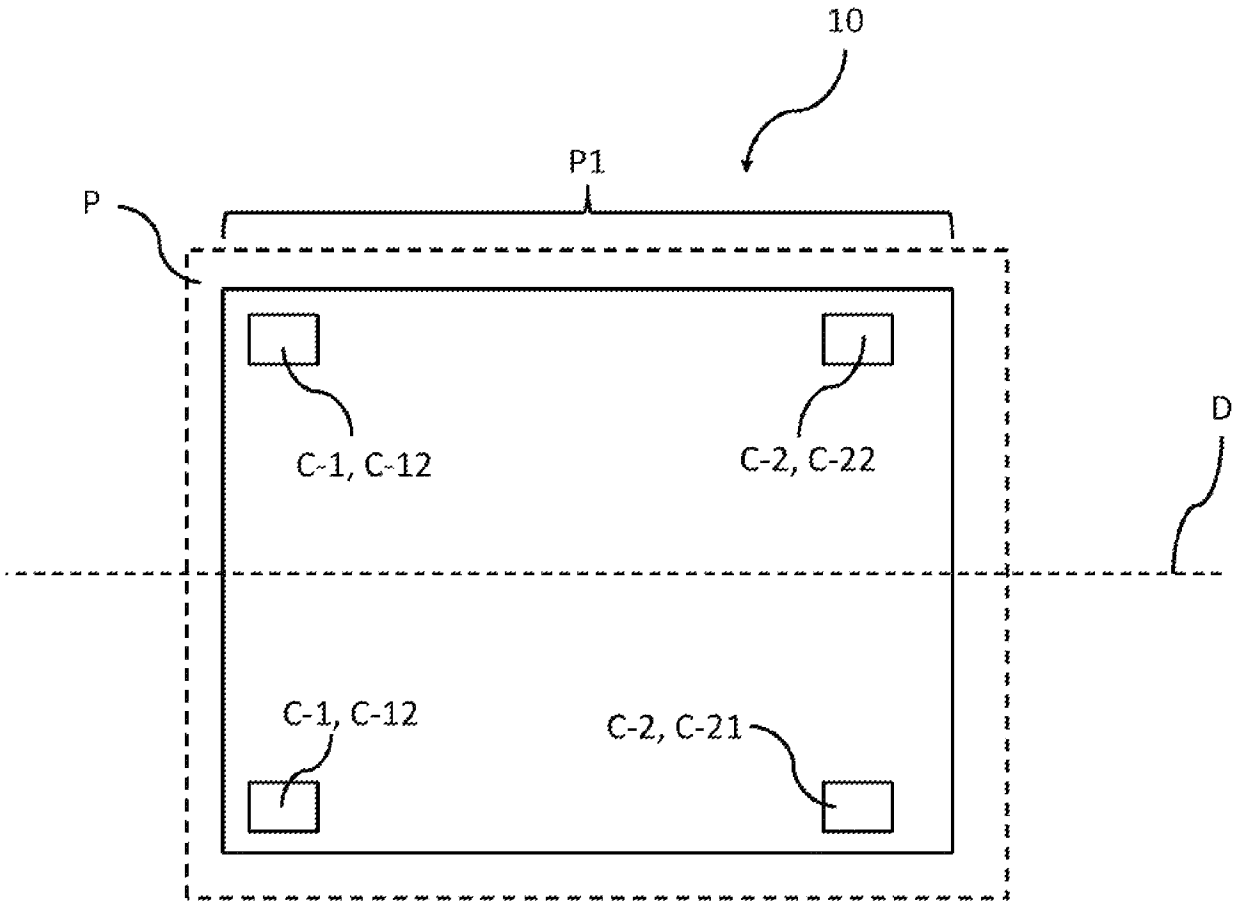
FIG. 5*b* diagrammatically shows a top view of the surface of physical exercise in FIG. 5*a;*

According to the present invention, as shown for example in FIGS. 2, 5*a*-5*b*, the plurality P-C of load cells comprises a first pair C-1 of load cells and a second pair C-2 of load cells arranged in series along the direction of longitudinal development D. As further described hereafter, the first pair C-1 of load cells and the second pair C-2 of load cells are adapted to define a first force plate P1.

For the purposes of the present description, "load cell means any force sensor or transducer adapted to detect data (orientation and magnitude) representative of a local force vector applied on the portion of the surface of physical exercise below which the force sensor or transducer is present.

It is understood that any sensor or transducer capable of detecting a force value applied thereto and configured to generate an electrical voltage or current proportional to the force value detected can be employed in the present invention.

An example of a load cell to be used in the present invention is a strain gage or resistor, i.e., a load cell which can vary an electrical output resistance as a result of mechanical deformation, from which it is possible to define and quantify the value of the input force which generated the mechanical deformation undergone by the load cell.

A further example of a load cell to be used in the present invention is a piezoelectric transducer, i.e., a load cell adapted to detect the force value applied thereto through the phenomenon of piezoelectricity, i.e., the mechanical-electrical ability of some crystals to generate electrical voltage proportional to the force value associated with the deformation applied to the load cell.

From a functional point of view, examples of load cells are of the compression, tension, bending, button, shear type, and so on.

The local force vector detectable by a load cell is a local constraint reaction.

For the purpose of the present description, "local constraint reaction" means a local force applied at the load cell by a constraint represented by the surface of physical exercise 10.

A load cell can work "under tension" or "under compression" according to the actual position that the user U has on the portion PZ of the surface of physical exercise 10 during the interaction with surface of physical exercise 10 with respect to the load cell.

If the load cell works "under tension", the local force vector that the load cell can detect has a first orientation along the direction orthogonal to the portion PZ of the surface of physical exercise 10.

If the load cell works "under compression", the local force vector that the load cell can detect has a second orientation along the direction orthogonal to the portion PZ of the surface of physical exercise 10, opposite to the first orientation.

For the purposes of the present description, "first orientation" means a downward orientation from the portion PZ of the surface of physical exercise.

According to this definition, the "first orientation" is a "negative" orientation, the corresponding local force vector (local constraint reaction) is defined as a negative local force vector (negative local constraint reaction), and the electrical signal generated by the load cell is negative.

For the purposes of the present description, "second orientation" means an upward orientation from the portion PZ of the surface of physical exercise.

According to this definition, the "second orientation" is a "positive" orientation, the corresponding local force vector (local constraint reaction) is defined as a positive local force vector (positive local constraint reaction), and the electrical signal generated by the load cell is positive.

Therefore, the local constraint reaction has the same sign as the electrical signal generated by the load cell.

In greater detail, the electrical signal generated by the load cell has a positive sign if the load cell is subjected to "compression" and has a negative sign if the load cell is subjected to "tension".

In greater detail, the local constraint reaction is correlated to the electrical signal (e.g., electrical voltage) generated by the load cell unless the sensor has its own conversion coefficients dependent on the construction features of the load cell and known a priori.

Figure 6A:
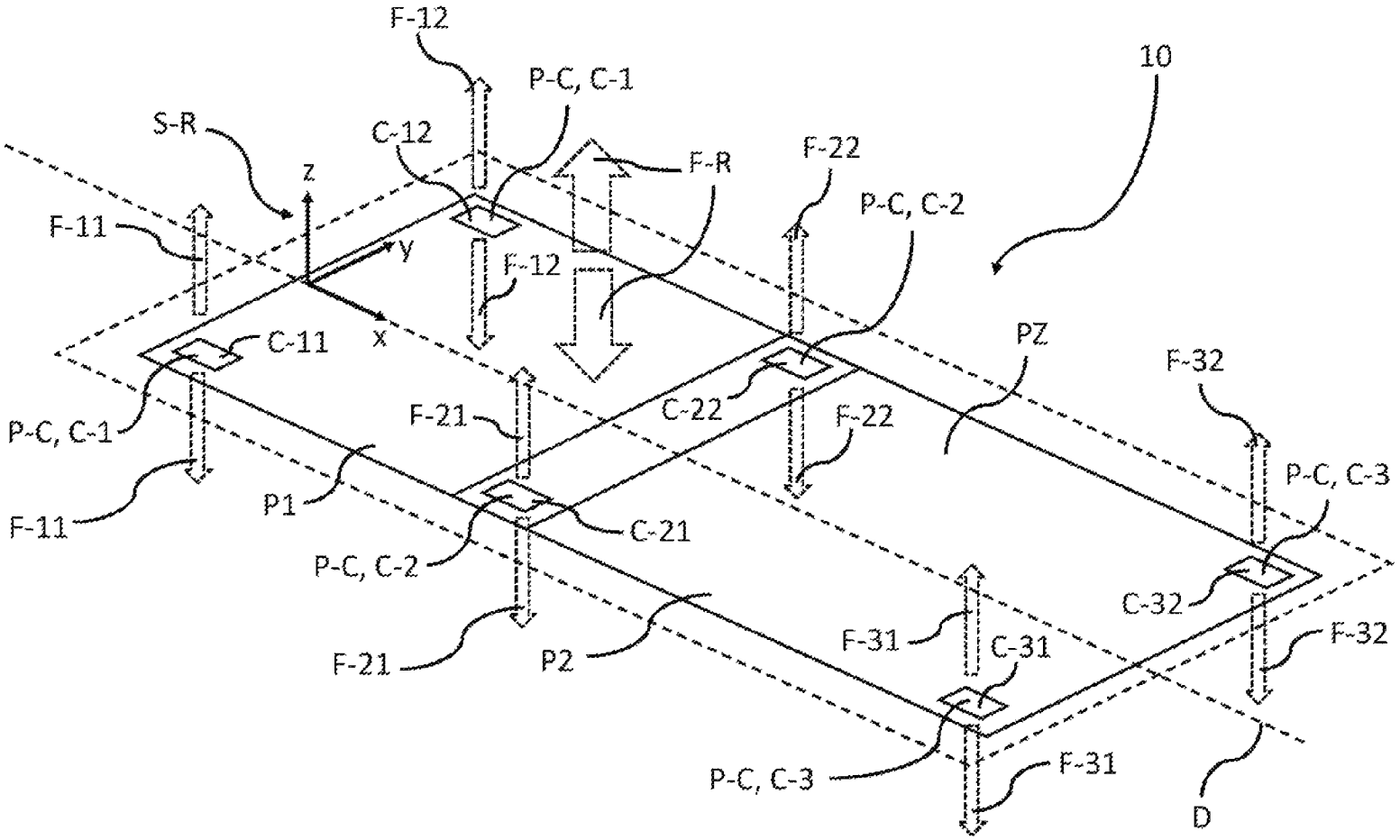
FIG. 6*a* diagrammatically shows a perspective view of a surface of physical exercise of a treadmill, according to the embodiment shown in FIGS. 3*a*-3*e;*

Negative local force vectors (negative local constraint reactions), according to the aforesaid definition, are shown for example in FIG. 5*a* with respective arrows F-11, F-12, F-21, F-22 and in FIG. 6*a* with respective arrows F-11, F-12, F-21, F-22, F-31, F-32 pointing downward at each load cell of the plurality P-C of load cells.

Positive local force vectors (positive local constraint reactions), according to the above definition, are shown for example in FIG. 5*a* with respective arrows F-11, F-12, F-21, F-22 and in FIG. 6*a* with respective arrows F-11, F-12, F-21, F-22, F-31, F-32 pointing upward at each load cell of the plurality P-C of load cells.

According to the present invention, as shown in particular in FIGS. 2, 3*a*-3*e*, 4*a*-4*b*, 5*a*-5*b*, 6*a*-6*b*, 7*a*-7*b*, the plurality P-C of load cells is arranged, parallel to the direction of longitudinal development D of the base 1 of the treadmill 100, at a first side of the surface of physical exercise 10 and at a second side of the surface of physical exercise 10.

According to the present invention, as shown in FIGS. 2, 3*a*-3*e*, 4*a*-4*b*, the treadmill 100 further comprises a first supporting component G-1 of the surface of physical exercise 10 and a second supporting component G-2 of the surface of physical exercise 10 arranged on the first side of the surface of physical exercise 10 and the second side of the surface of physical exercise 10, respectively, parallel to the direction of longitudinal development D of the base 1 of the treadmill 100.

The surface of physical exercise 10 is mechanically connected to the first supporting component G-1 and the second supporting component G-2 to slide along the direction of longitudinal development D of the base 1 of the treadmill 100.

The plurality P-C of load cells is arranged under the first supporting component G-1 of the surface of physical exercise 10 and the second supporting component G-2 of the surface of physical exercise 10.

In greater detail, as shown in FIGS. 2, 3*a*-3*e*, 4*a*-4*b*, the plurality P-C of load cells is fixed, for example by means of screws, to the upper part of the plurality of connecting elements E-R at the ends of each connecting element.

The first supporting component G-1 of the surface of physical exercise 10 and the second supporting component G-2 of the surface of physical exercise 10 are fixed to the base 1 of the treadmill 100 so that each load cell of the plurality of load cells P-C is interposed between the connecting element to which the load cell is fixed and the first supporting component G-1 of the surface of physical exercise 10 or the second supporting component G-2 of the surface of physical exercise 10, depending on whether the end of the connecting element is that fixed to the first supporting element E-1 or that fixed to the second supporting element E-2, respectively.

Each load cell of said plurality P-C of load cells is thus located on the load transmission path from the surface of physical exercise 10 to the base 1 of the treadmill 100 and is thus capable of detecting the local force vector associated with such a load.

According to FIG. 2, the plurality of connecting elements E-R comprises a first connecting element E-R1, a second connecting element E-R2 and a third connecting element E-R3.

According to an embodiment, in combination with the preceding one and shown in FIGS. 2, 3*a*-3*e*, 4*a*-4*b*, the first supporting component G-1 of the surface of physical exercise 10 comprises a first plurality R-1 of revolving elements and the second supporting component G-2 of the surface of physical exercise 10 comprises a second plurality R-2 of revolving elements.

Each revolving element of said first plurality R-1 of revolving elements and of said second plurality R-2 of revolving elements is coupled to the respective supporting component (first G-1 or second G-2) so as to be freely rotatable about a respective axis of rotation.

According to an embodiment, in combination with any of the proceeding ones, shown in FIGS. 5*a*-5*b*, 6*a*-6*b*, 7*a*-7*b*:

the first pair C-1 of load cells, transverse to the direction of longitudinal development D of the base 1 of the treadmill 100, comprises a first load cell C-11 arranged at the first side of the surface of physical exercise 10 and a second load cell C-12 arranged at the second side of the surface of physical exercise 10; and the second pair C-2 of load cells, transverse to the direction of longitudinal development D of the base 1 of the treadmill 100, comprises a first load cell C-21 arranged at the first side of the surface of physical exercise 10 and a second load cell C-22 arranged at the second side of the surface of physical exercise 10.

In greater detail, the first load cell C-11 and the second load cell C-12 (described hereafter) of the first pair C-1 of load cells are fixed to the end of the first connecting element E-R1 at the first side of the surface of physical exercise 10 and to the end of the first connecting element E-R1 at the second side of the surface of physical exercise 10, respectively.

The first load cell C-21 and the second load cell C-22 (described below) of the second pair C-2 of load cells are fixed to the end of the third connecting element E-R3 at the first side of the surface of physical exercise 10 and to the end of the first connecting element E-R1 at the second side of the surface of physical exercise 10, respectively.

According to an embodiment, in combination with the preceding one, shown in FIGS. 2, 3*a*-3*e*, 4*a*-4*b*, 5*a*-5*b*, 6*a*-6*b*, 7*a*-7*b*, the first load cell (C-11 or C-21) and the respective second load cell (C-12 or C-22, respectively) of each pair of load cells are substantially aligned with each other (C-11 with C12; C-21 with C-22) transversely to the direction of longitudinal development D of the base 1 of the treadmill 100.

According to an embodiment, in combination with any of the preceding ones in which the plurality P-C of load cells comprises the first pair C-1 of load cells and the second pair C-2 of load cells and shown in FIGS. 3*a*-3*e*, 6*a*-6*b*, the plurality P-C of load cells further comprises a third pair C-3 of load cells.

The first pair C-1 of load cells, the second pair C-2 of load cells and the third pair C-3 of load cells are arranged in series along the direction of longitudinal development D of the base 1 of the treadmill 100.

The third pair C-3 of load cells is arranged so that, along the direction of longitudinal development D of the base 1 of the treadmill 100, the second pair C-2 of load cells is sandwiched between the first pair C-1 of load cells and the second pair C-3 of load cells.

Figure 6B:
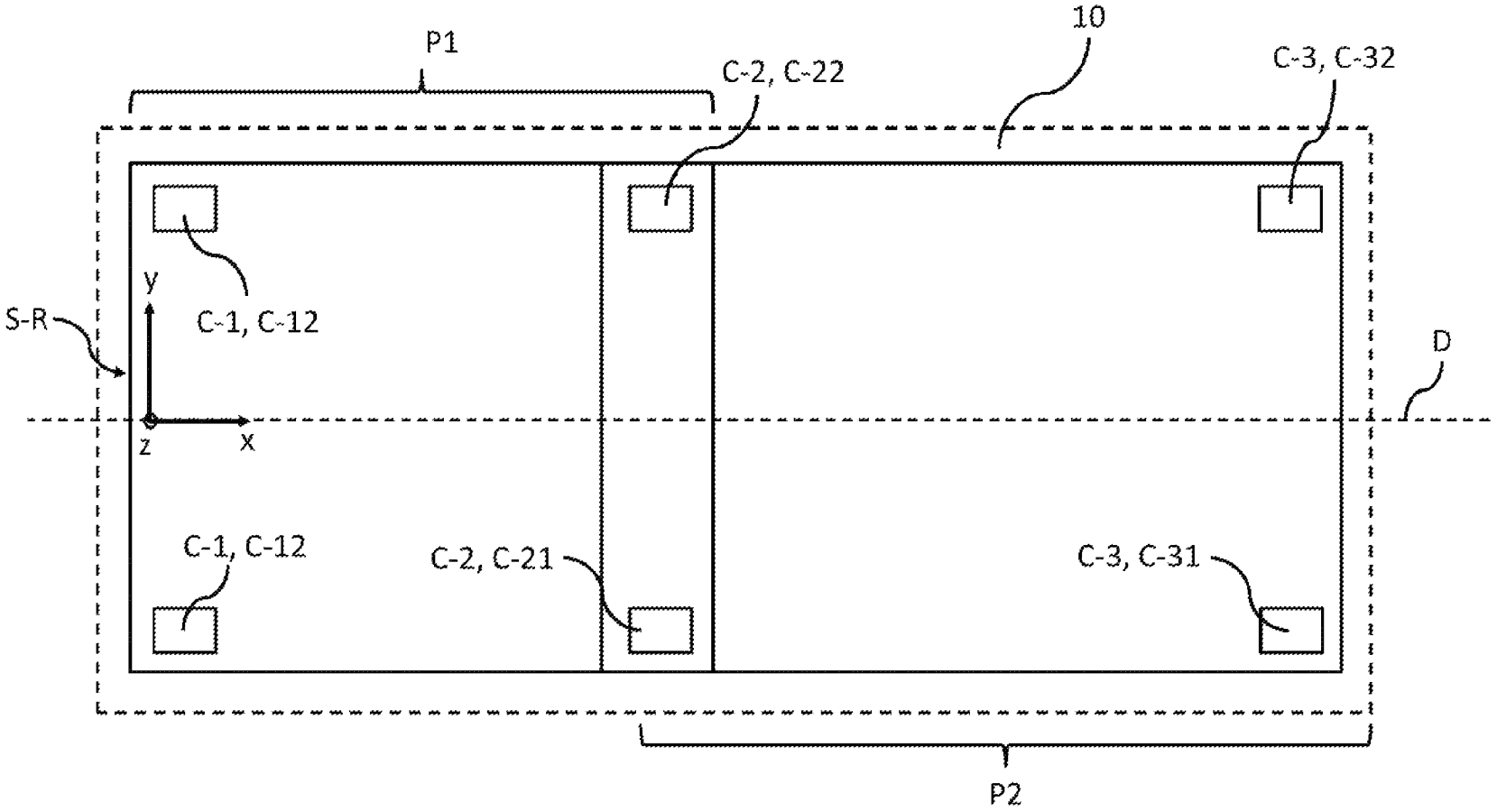
FIG. 6*b* diagrammatically shows a top view of the surface of physical exercise in FIG. 6*a;*
Figure 7A:
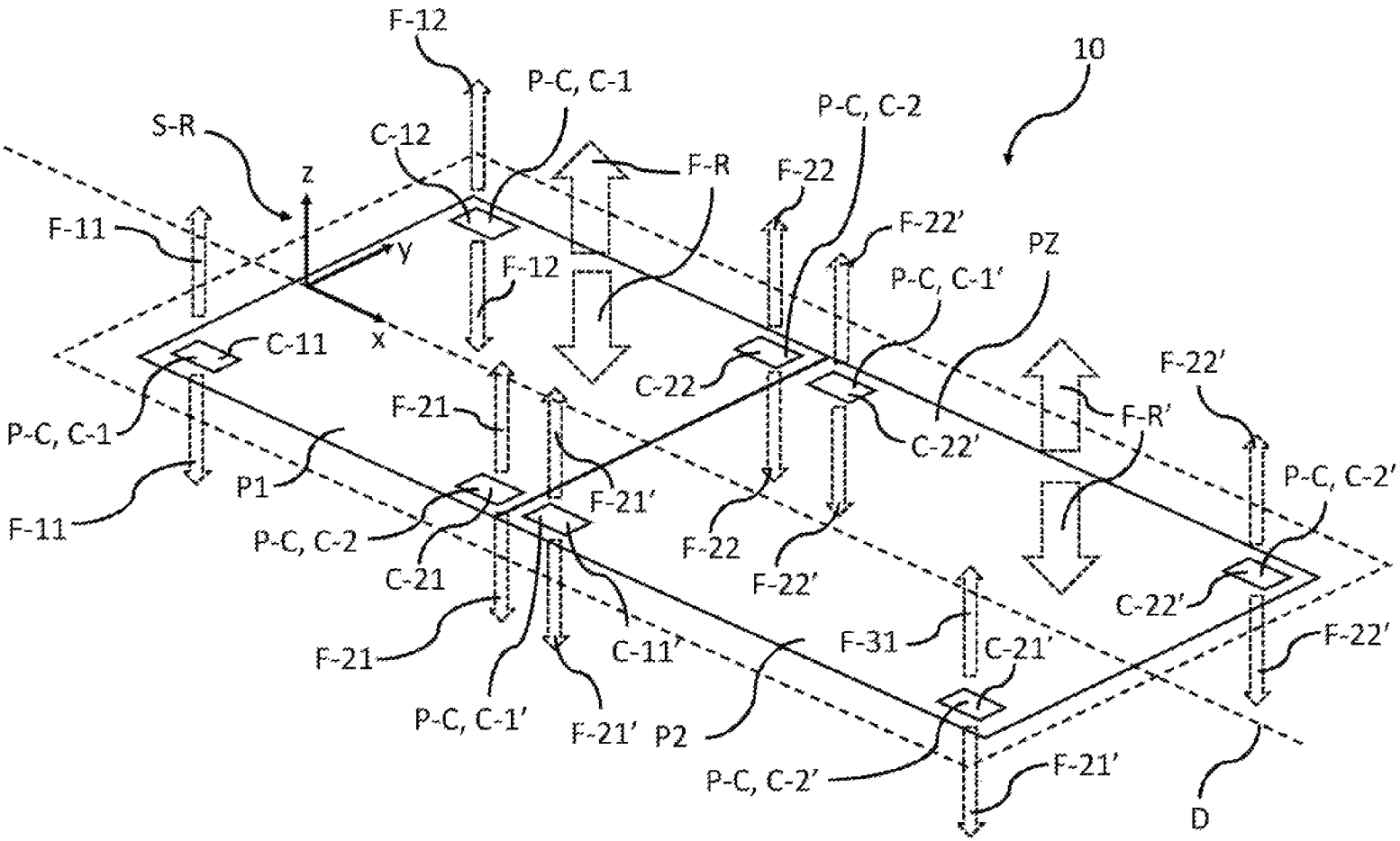
FIG. 7*a* diagrammatically shows a perspective view of a surface of physical exercise of a treadmill, according to the embodiment shown in FIGS. 4*a*-4*b;*
Figure 7B:
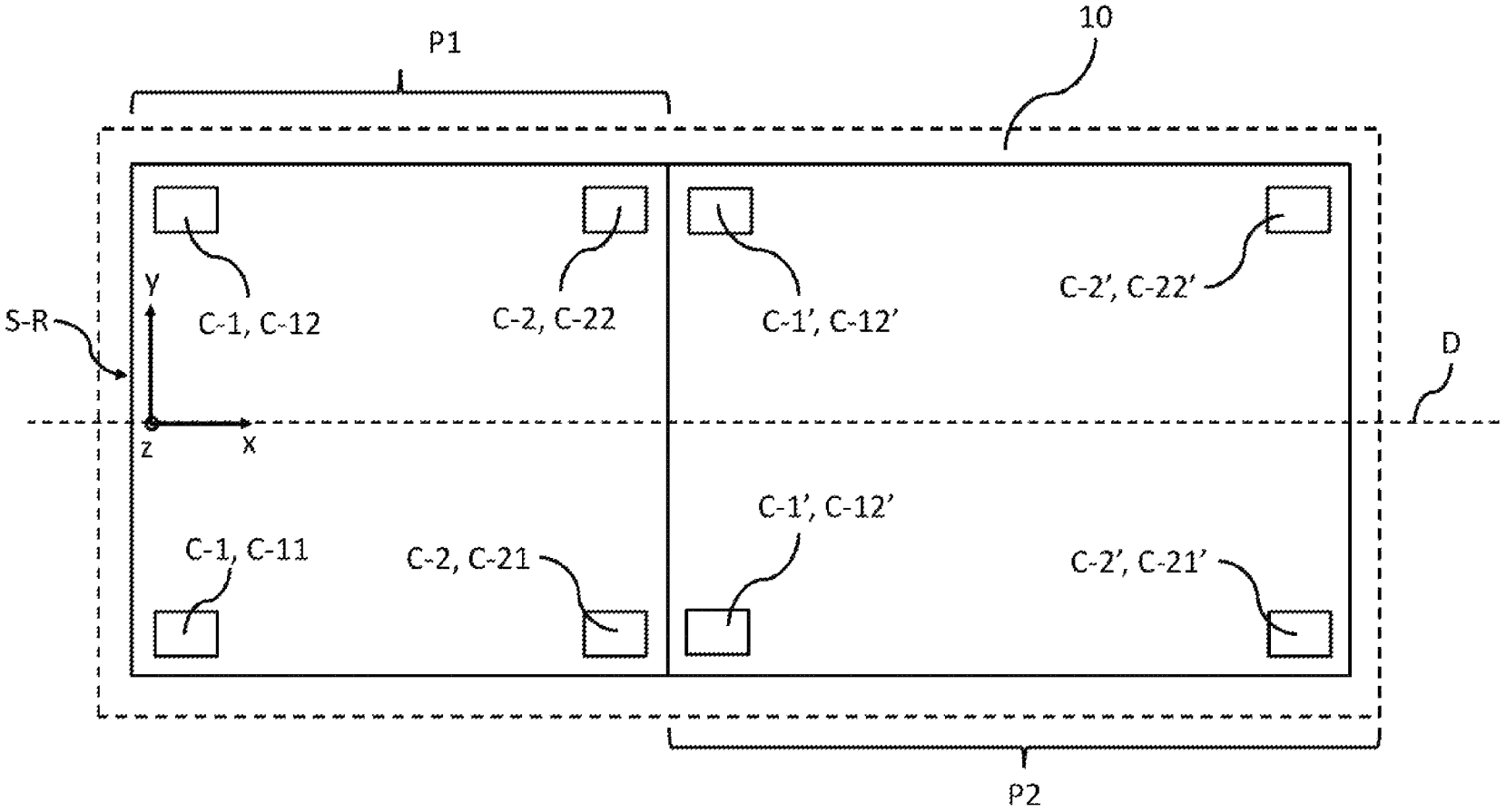
FIG. 7*b* diagrammatically shows a top view of the surface of physical exercise in FIG. 7*a;*

The second pair C-2 of load cells and the third pair C-3 of load cells are adapted to define a second force plate P2 (diagrammatically indicated in FIGS. 6*a* and 6*b*).

According to this embodiment, the first force plate P1 and the second force plate P2 thus share a pair of cells (in particular, the second pair C-2 of load cells).

The functionalities of two separate force plates can thus be achieved with a lower number of load cells and a simpler system configuration.

According to an embodiment, in combination with the proceeding one and shown in FIGS. 3*a*-3*e*, 6*a*-6*b*:

the third pair C-3 of load cells, transverse to the direction of longitudinal development of the base 1 of the treadmill 100, comprises a first load cell C-31 arranged at the first side of the surface of physical exercise 10 and a second load cell C-32 arranged at the second side of the surface of physical exercise 10.

In this embodiment, according to FIGS. 3*a*-3*e*, the plurality of connecting elements E-R of the supporting structure S-P comprises the first connecting element E-R1, the second connecting element E-R2 and the third connecting element E-R3.

In greater detail, the first load cell C-11 and the second load cell C-12 (described hereafter) of the first pair C-1 of load cells are fixed to the end of the first connecting element E-R1 at the first side of the surface of physical exercise 10 and to the end of the first connecting element E-R1 at the second side of the surface of physical exercise 10, respectively.

The first load cell C-21 and the second load cell C-22 (described below) of the second pair C-2 of load cells are fixed to the end of the second connecting element E-R2 at the first side of the surface of physical exercise 10 and to the end of the first connecting element E-R1 at the second side of the surface of physical exercise 10, respectively.

The first load cell C-31 and the second load cell C-32 (described below) of the third pair C-3 of load cells are fixed to the end of the third connecting element E-R3 at the first side of the surface of physical exercise 10 and to the end of the first connecting element E-R1 at the second side of the surface of physical exercise 10, respectively.

According to an embodiment, in combination with the preceding one, shown in FIGS. 3*a*-3*e*, 6*a*-6*b*, the first load cell C-31 and the second load cell C-32 of the third pair C-3 of load cells are substantially aligned with each other transversely to the direction of longitudinal development D of the base 1 of the treadmill 100.

In an embodiment, in combination with any of those described above in which the plurality P-C of load cells comprises the first pair C-1 of load cells and the second pair C-2 of load cells (FIG. 2) and shown in FIGS. 4*a*, 4*b*, 7*a* and 7*b*, the plurality P-C of load cells comprises a further first pair C-1' of load cells and a further second pair C-2' of load cells arranged in series along the direction of longitudinal development D.

The further first pair C-1' of load cells and the further second pair C-2' of load cells are adapted to define a second force plate P2.

In greater detail, the further first pair C-1' of load cells and the further second pair C-2' of load cells are arranged in series along the direction of longitudinal development D of the base 1 of the treadmill 100 so that the second force plate P2 is in series with the first force plate P1 (defined by the first C-1 pair of load cells and the second pair C-2 of load cells) along the direction of longitudinal development D of the base 1 of the treadmill 100.

Figure 4A:
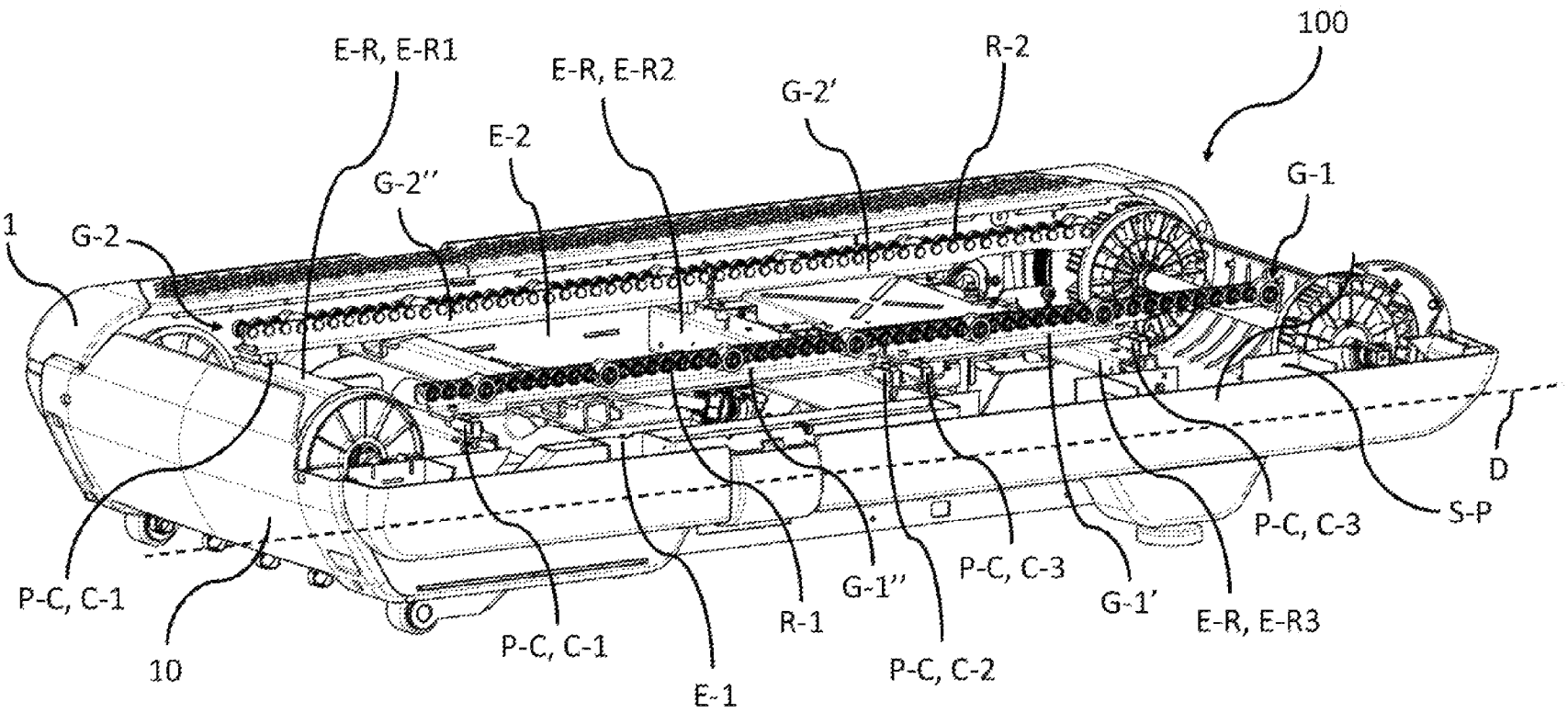
FIG. 4*a* diagrammatically shows an exploded perspective view of a component of the treadmill in FIG. 1*a* according to a further embodiment of the present invention.
Figure 4B:
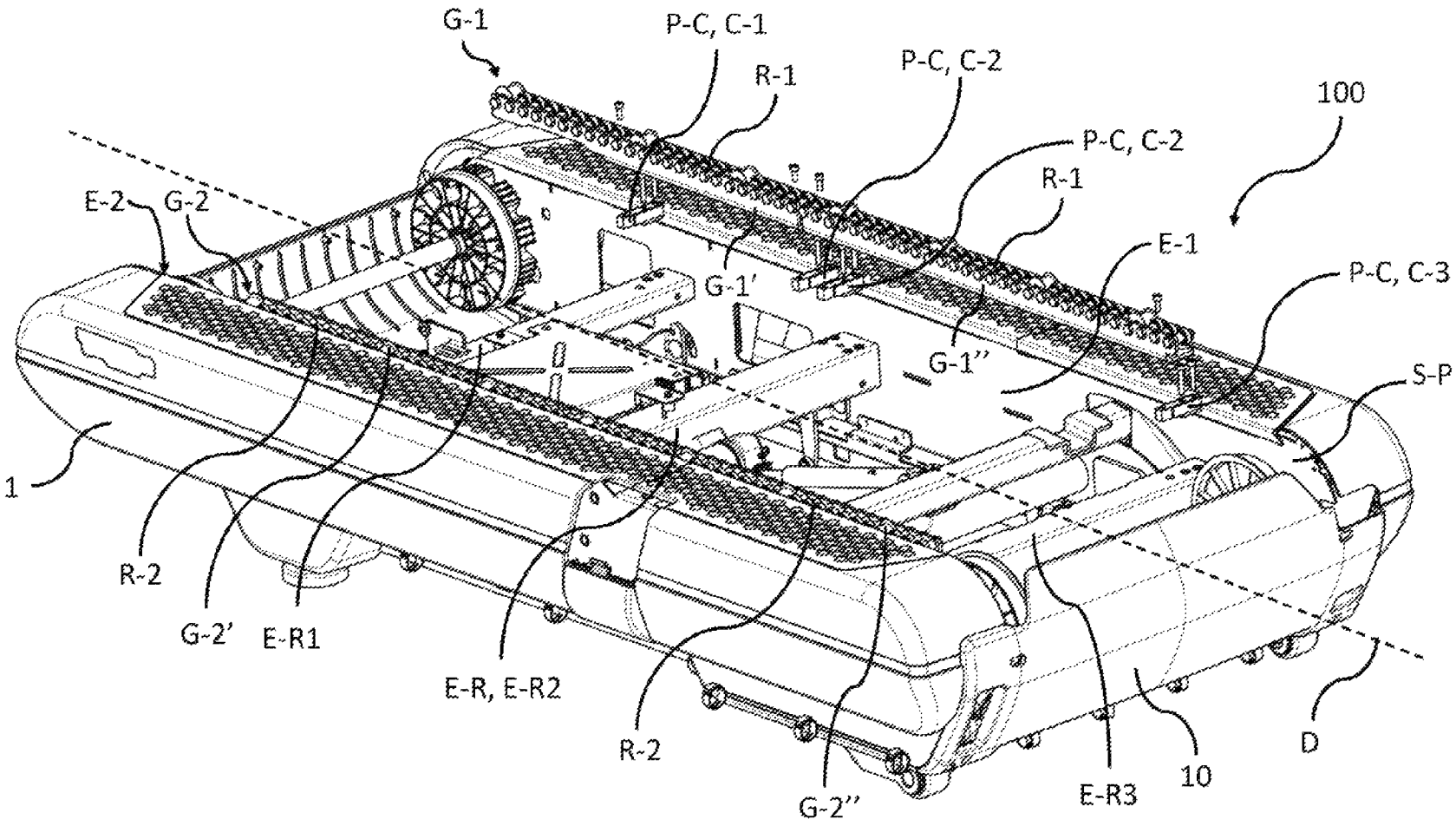
FIG. 4*b* diagrammatically shows a further exploded perspective view of the component of the treadmill in FIG. 1*a*, according to the embodiment in FIG. 4*a;*

In this embodiment, according to FIGS. 4a-4b, the plurality of connecting elements E-R of the supporting structure S-P comprises the first connecting element E-R1, the second connecting element E-R2 and the third connecting element E-R3.

In greater detail, the first load cell C-11 and the second load cell C-12 of the first pair C-1 of load cells are fixed to the end of the first connecting element E-R1 at the first side of the surface of physical exercise 10 and to the end of the first connecting element E-R1 at the second side of the surface of physical exercise 10, respectively.

The first load cell C-21 and the second load cell C-22 (described below) of the second pair C-2 of load cells are fixed to the end of the second connecting element E-R2 at the first side of the surface of physical exercise 10 and to the end of the second connecting element E-R2 at the second side of the surface of physical exercise 10, respectively.

The first load cell C-21 and the second load cell C-22' of the further first pair C-1' of load cells are fixed to the end of the second connecting element E-R2 at the first side of the surface of physical exercise 10 and to the end of the second connecting element E-R2 at the second side of the surface of physical exercise 10, respectively.

The first load cell C-21' and the second load cell C-22' of a further second pair C-2' of load cells are fixed to the end of the third connecting element E-R3 at the first side of the surface of physical exercise 10 and to the end of the first connecting element E-R1 at the second side of the surface of physical exercise 10, respectively.

It should be noted that in this embodiment, as shown in FIGS. 4a and 4b, the first supporting component G-1 of the surface of physical exercise 10 comprises a respective first portion G-1' and a respective second portion G-1" separated from each other.

Moreover, the second supporting component G-2 of the surface of physical exercise 10 comprises a respective first portion G-2' and a respective second portion G-2" separated from each other.

The first supporting component G-1 of the surface of physical exercise 10 is fixed to the base 1 of the treadmill 100 so that the first load cell C-11 of the first pair C-1 of load cells and the first load cell C-21 of the second pair C-2 of load cells are interposed between the connecting element to which the load cells are fixed and the first portion G-1' of the first supporting component G-1 of the surface of physical exercise 10 and so that the first load cell C-11' of the further first pair C-1' of load cells and the first load cell C-21' of the further second pair C-2' of load cells are interposed between the connecting element to which each load cell is fixed and the second portion G-1" of the first supporting component G-1 of the surface of physical exercise 10.

Moreover, the second supporting component G-2 of the surface of physical exercise 10 is fixed to the base 1 of the treadmill 100 so that the second load cell C-12 of the first pair C-1 of load cells and the second load cell C-22 of the second pair C-2 of load cell are interposed between the connecting element to which the load cells are fixed and the first portion G-2' of the second supporting component G-2 of the surface of physical exercise 10 and so that the second load cell C-12' of the further first pair C-1' of load cells and the second load cell C-22' of the further second C-2' pair of load cells are interposed between the connecting element to which each load cell is fixed and the second portion G-2" of the second supporting component G-2 of the surface of physical exercise 10.

The fact that the first portion G-1' and the respective second portion G-1" of the first supporting component G-1 of the surface of physical exercise 10 are separated from each other and that the first portion G-2' and the respective second portion G-2" of the second supporting component G-2 of the surface of physical exercise 10 are separated from each other advantageously allows avoiding mutual mechanical constraints which can affect the correct operation of the first force plate P1 and the second force plate P2.

The description of the first pair C-1 of load cells and the second pair C-2 of load cells (first force plate P1) and the further first pair C-1' and the further second pair C-2' of load cells (second force plate P2) is identical to that of the first pair C-1 of load cells and the second pair C-2 of load cells (first force plate P1) already given with reference to the embodiment in FIGS. 2, 5a-5b and therefore will no longer be repeated for brevity.

Again hereafter, with reference to the operation of the treadmill 100, in an embodiment, the description given with reference to the first pair of load cells C-1 and the second pair of load cells C-2 (first force plate P1) of the embodiment in FIGS. 2, 5a-5b also applies to the first pair C-1 of load cells and the second pair C-2 of load cells (first force plate P1) and the further first pair C-1' and the further second pair C-2' of load cells (second force plate P2) of the embodiment in FIGS. 4a-4b, 7a-7b.

Moreover, again with reference to the operation of the treadmill 100, in a further embodiment, the description given with reference to the first pair C-1 of load cells and the second pair C-2 of load cells (first force plate P1) and to the second pair C-2 of load cells and the third pair C-3 of load cells (second force plate P2) of the embodiment in FIGS. 3a-3e, 6a-6b also applies to the first pair C-1 of load cells and the second pair C-2 of load cells (first force plate P1) and the further first pair C-1' and the further second pair C-2' of load cells (second force plate P2) of the embodiment in FIGS. 4a-4b, 7a-7b.

In an embodiment, in combination with any of the preceding ones and shown in FIGS. 2, 3a-3e, 4a-4b, 5a-5b, 6a-6b, 7a-7b, the surface of physical exercise 10 comprises a plurality of slats having respective directions of longitudinal development substantially parallel to one another and transverse to the direction of longitudinal development D of the base 1 of the treadmill 100.

In an embodiment, in combination with the preceding one in which the surface of physical exercise 10 comprises a plurality of slats, it should be noted that both the first rotating element 2 and the second rotating element 3 comprise respective two pulleys arranged close to the side portions of the base 1 of the treadmill 100, transverse to the direction of longitudinal development D of the base 1 of the treadmill 100, designed to support the plurality of slats at the side edges of each slat.

In other words, in this further embodiment, the surface of physical exercise 10 has a roller shutter configuration.

Figure 1B:
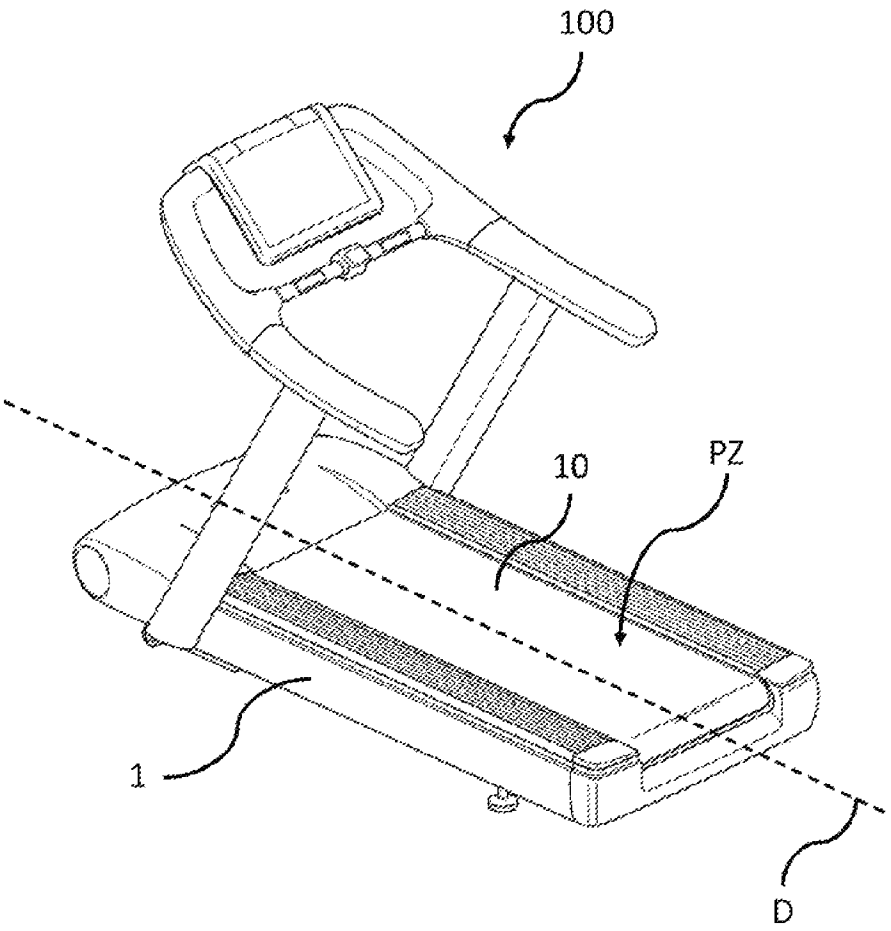
FIG. 1*b* shows a further example of a treadmill on which the present invention is implementable.

According to an embodiment, shown in FIG. 1b, in combination with any of the preceding ones and as an alternative to those which require the surface of physical exercise 10 to comprise a plurality of slats, the surface of physical exercise 10 comprises a belt wrapped around the first rotating element 2 and the second rotating element 3.

In this embodiment, the treadmill 100 further comprises a support plank (not shown in the figure), arranged between the first rotating element 2 and the second rotating element 3 along the direction of longitudinal development D of the base 1 of the treadmill 100, adapted to support the belt while sliding.

The plurality P-C of load cells is arranged under the support plank.

In greater detail, the plurality of load cells is fixed, for example by screwing, to the plurality of connecting elements E-R of the supporting structure S-P as described above with reference to FIGS. 2, 3*a*-3*e*, 4*a*-4*b*.

In this embodiment, the first rotating element 2 and the second rotating element 3 each comprise a respective roll, each rotationally coupled to the base 1 of the treadmill 100 at the first and second ends of the base 1, to which the belt is connected.

According to a second embodiment, in combination with any of the preceding ones, with particular reference to FIG. 8, the treadmill 100 further comprises a data processing unit 30, e.g., a microprocessor or a microcontroller.

The data processing unit 30 is operatively connected to the plurality P-C of load cells.

The treadmill 100 further comprises a memory unit 31, operatively connected to the data processing unit 30.

The memory unit 31 can be either inside or outside (as shown in FIG. 2, for example) the data processing unit 30.

It should be noted that the memory unit 31 is configured to store one or more program codes which can be executed by the data processing unit 30 to control in general the treadmill 100, and in particular, to perform the steps of a method for determining information representative of the user's interaction with a surface of physical exercise of a treadmill, according to an embodiment of the present invention.

In general, the treadmill 100, by virtue of the functions of the plurality P-C of load cells and the data processing unit 30, is configured to perform the method for determining information representative of a user's interaction with a surface of physical exercise of a treadmill, described below with reference to FIG. 8.

In this respect, from a functional point of view, it should be noted that, according to the present invention, for each sampling time instant $t_i$, with $1<i<N$, of a plurality of subsequent sampling time instants $t_1, t_2, \ldots, t_{>N}$, with positive integer N, each load cell of said plurality P-C of load cells is configured to detect data representative of a respective local force vector F-11, F-12, F-21, F-22, F-31, F-32 along a direction orthogonal to a portion PZ of the surface of physical exercise 10 at said load cell and due to the interaction of the user U with the surface of physical exercise 10.

The "data representative of a local force vector" were defined above.

On the other hand, as for the operations which can be executed by the data processing unit 30 of the treadmill 100, according to the present invention, for each sampling time instant $t_i$, with $1<i<N$, of the plurality of subsequent sampling time instants $t_1, t_2, \ldots, t_N$, with positive integer N, the data processing unit 30 is configured to determine information representative of a resulting force vector F-R due to the interaction of the user U with the surface of physical exercise 10 of the treadmill 100 based on the data representative of the local force vectors detected by the plurality P-C of load cells.

In particular, as described below with reference to different embodiments, the data processing unit 30 is configured to determine the information representative of a resulting force vector F-R based on the data representative of local force vectors detected by one or both the load cells of one or more of said first pair C-1 of load cells, second pair C-2 of load cells, and, if present, third pair C-3 of load cells of the plurality P-C of load cells.

For the purposes of the present description, the "resulting force vector" is a physical quantity having a point of application (origin of the vector) lying on the plane defined by the portion PZ of the surface of physical exercise 10 the position of which is represented by a coordinate x and a coordinate y of a reference coordinate system S-R belonging to the portion PZ of the exercise surface 10.

The coordinate x lies on an axis x of the reference coordinate system S-R parallel to the direction of longitudinal development D of the base 1 of the treadmill 100, and the coordinate y lies on an axis y of the reference coordinate system transverse to the direction of longitudinal development D of the base 1 of the treadmill 100.

The coordinate x represents the position of the point of application of the resulting force vector F-R on the portion PZ of the surface of physical exercise 10 along the direction of longitudinal development D of the base of the treadmill 100.

The coordinate y represents the position of the point of application of the resulting force vector F-R on the portion PZ of the surface of physical exercise 10 transverse to the direction of longitudinal development D of the base 1 of the treadmill 100.

The point of application of the resulting force vector F-R is representative of the position of the center of pressure generated by the user U in contact with the portion PZ of the surface of physical exercise 10.

The reference coordinate system S-R has the respective origin on the portion PZ of the surface of physical exercise 10.

Figures 3A, 3B:
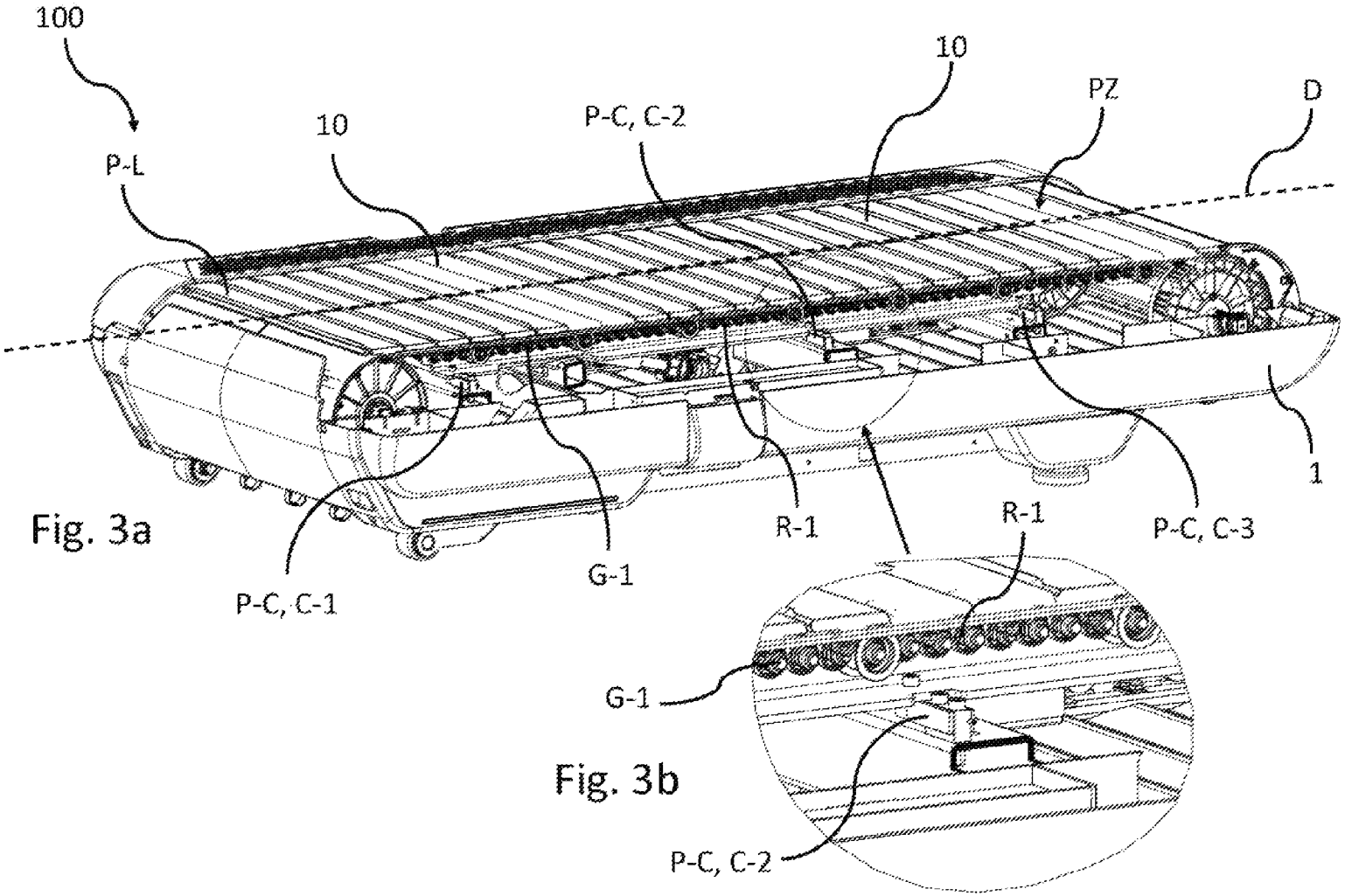
FIG. 3*a* diagrammatically shows a perspective view of a component of the treadmill in FIG. 1*a* according to a further embodiment of the present invention.
FIG. 3*b* shows an enlargement of FIG. 3*a;*
Figure 3C:
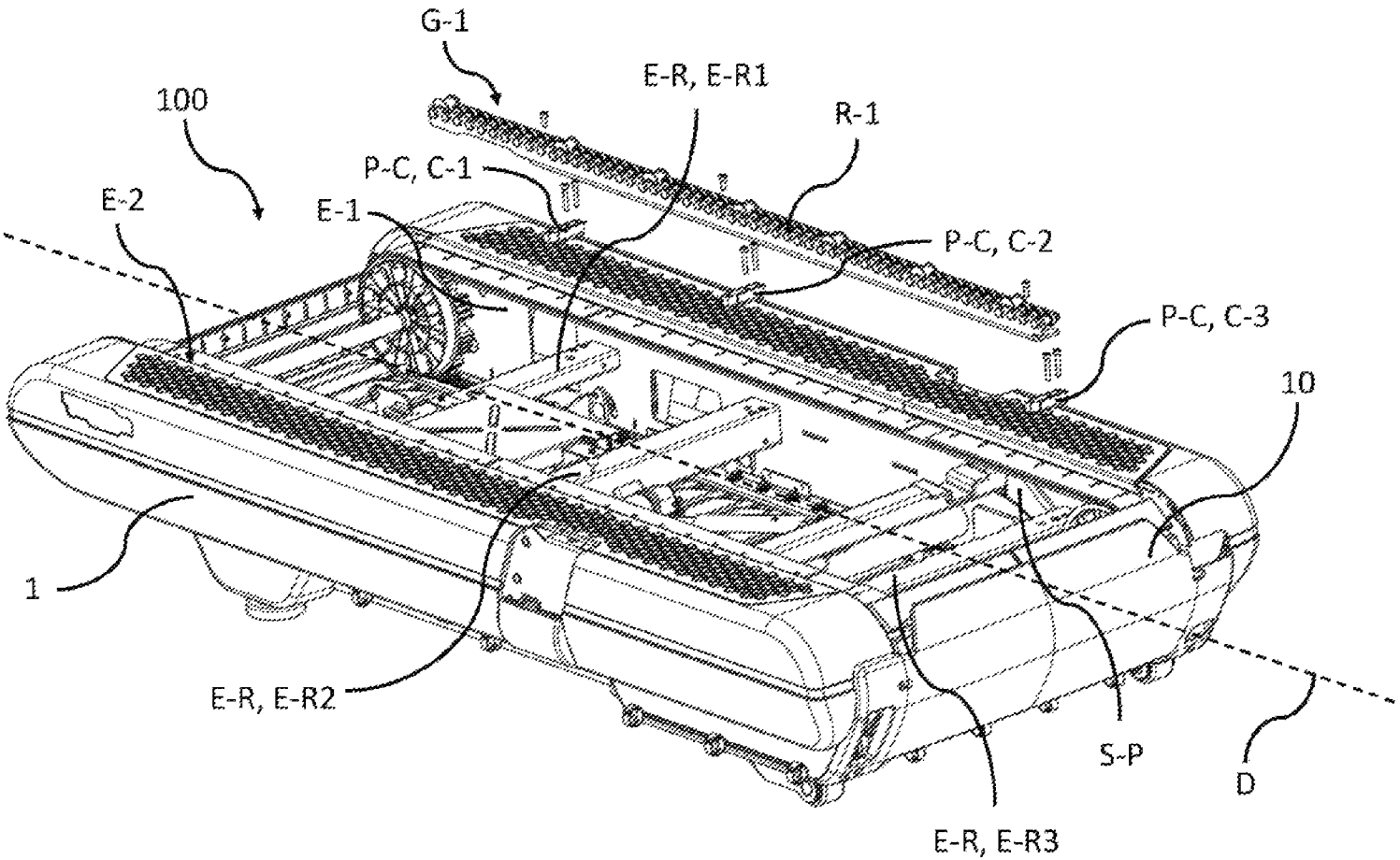
FIG. 3*c* diagrammatically shows an exploded perspective view of the treadmill component in FIG. 3*a;*
Figure 3D:
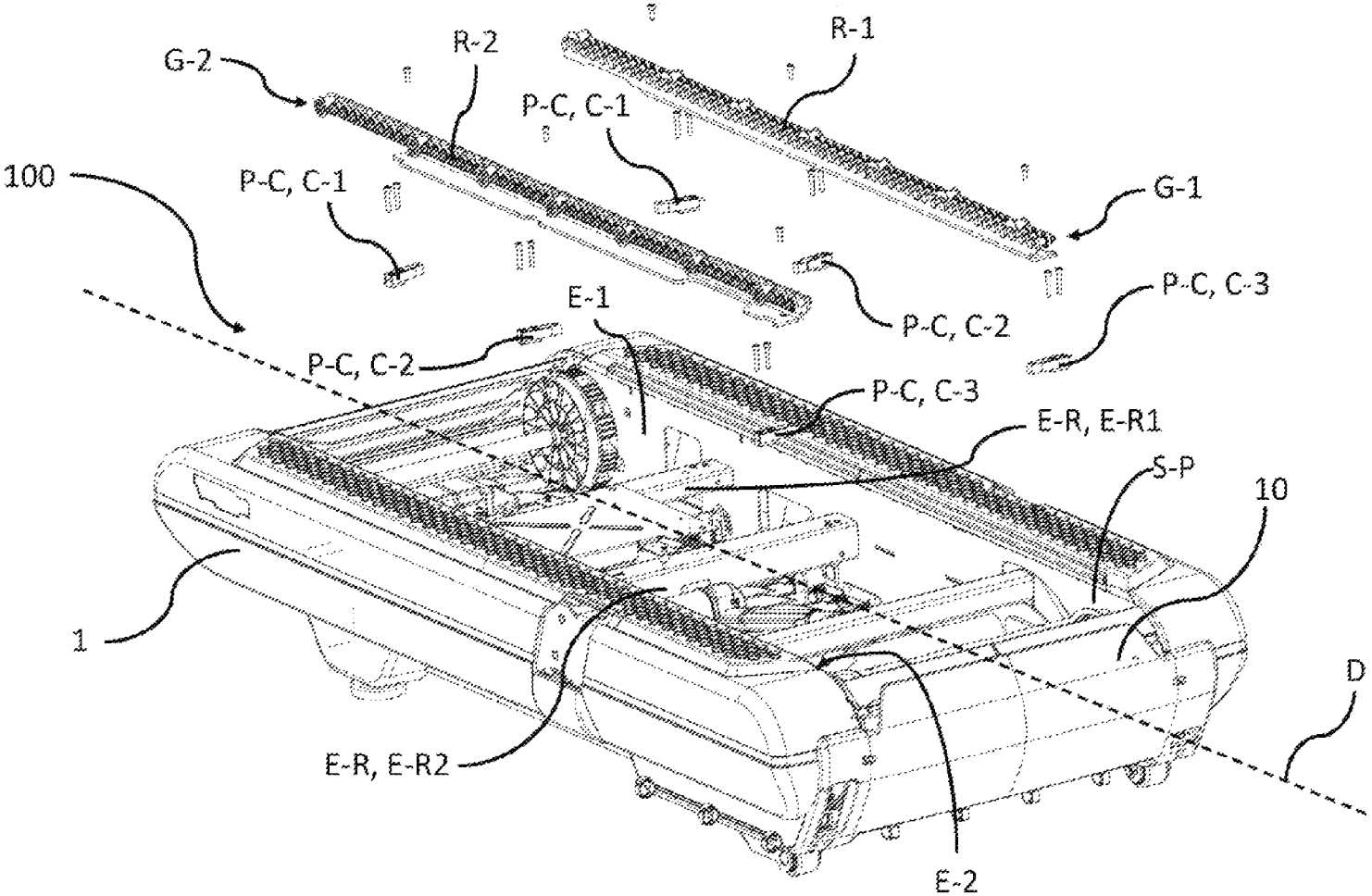
FIG. 3*d* diagrammatically shows a further exploded perspective view of the treadmill component in FIG. 3*a;*
Figure 3E:
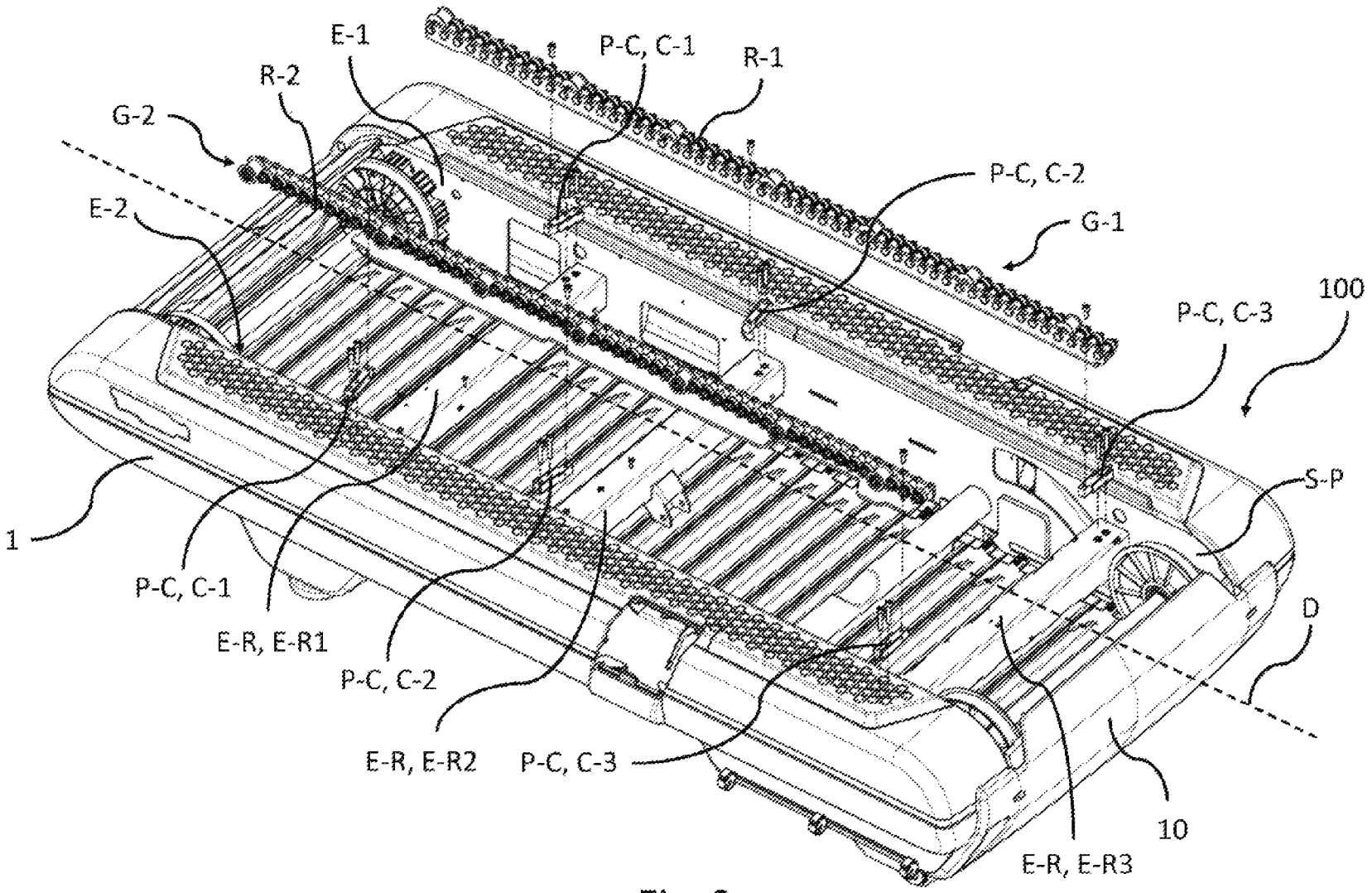
FIG. 3*e* diagrammatically shows a further exploded perspective view of the treadmill component in FIG. 3*a;*

In this respect, for simplicity and as shown in FIGS. 3*a* and 4*a*, the origin of the reference coordinate system S-R can be assumed to be at a point along the direction of longitudinal development D between the first load cell C-11 and the second load cell C-12 of the first pair C-1 of load cells.

Again, for the purposes of the present invention, the physical quantity "resulting force vector" has:

- a magnitude representing the intensity or amplitude of the resulting force vector F-R;
- a direction orthogonal to the portion PZ of the surface of physical exercise 10, parallel to an axis z of the reference coordinate system S-R orthogonal to the portion PZ of the surface of physical exercise 10 on which coordinate x and coordinate y of the reference coordinate system S-R lie;
- a direction (upward or downward with respect to the portion PZ of the surface of physical exercise 10) defined by the sign of the resulting force vector F-R (positive or negative).

With particular reference to the center of pressure associated with the user U in contact with the portion PZ of the surface of physical exercise 10, in greater detail, it should be noted that it is defined as the projection orthogonal to the portion PZ of the surface of physical exercise 10 of the center of mass of the body in contact with the portion PZ of the surface of physical exercise 10 itself.

The center of mass represents the spatial location of the point which concentrates all the mass of the body in contact with the portion PZ of the surface of physical exercise 10.

With particular reference to the magnitude of the resulting force vector F-R, in greater detail, it should be noted that it represents the vertical component of the so-called ground reaction force (GRF), which in physics, and in particular in biomechanics, is the force applied by the ground on a body in contact therewith (in the present case, it is thus the force applied by the portion PZ of the surface of physical exercise 10 on the user U).

According to an embodiment, in combination with the preceding one, said information representative of the resulting force vector F-R comprises at least one coordinate x of the resulting force vector F-R in a reference coordinate system S-R in which the coordinate x lies on an axis x of the reference coordinate system S-R parallel to the direction of longitudinal development D of the base 1 of the treadmill 100 and in which the coordinate x lies on the portion PZ of the surface of physical exercise 10.

In this embodiment, in determining the information representative of the resulting force vector F-R based on the data representative of the local force vectors detected by the plurality P-C of load cells, the data processing unit 30 is configured to determine the first coordinate x of the resulting force vector F-R.

As mentioned above, the coordinate x of the resulting force vector F-R represents the position of the point of application of the resulting force vector F-R on the portion PZ of the surface of physical exercise 10 along the direction of longitudinal development D of the base of the treadmill 100.

According to an embodiment, in combination with the preceding one in which the determination of the coordinate x of the resulting force vector F-R is provided, and only the first pair C-1 of load cells and the second pair C-2 of load cells are adapted to define a first force plate P1, the data processing unit 30 is configured to determine the coordinate x of the resulting force vector F-R based on the data representative of the local force vectors detected by the first force plate P1 identifiable by processing respective electrical signals which can be generated by the first pair C-1 of load cells and the second pair C-2 of load cells.

According to an embodiment, in combination with any of the preceding ones in which the determination of the coordinate x of the resulting force vector F-R is provided, and the first pair C-1 of load cells and the second pair C-2 of load cells adapted to define a first force plate P1 are present and the second pair C-2 of load cells and the third pair C-3 of load cells adapted to define a second force plate P2 are also present, the data processing unit 30 is configured to determine the coordinate x of the resulting force vector F-R based on the data representative of local force vectors detected by the first force plate P1 identifiable by processing only respective electrical signals which can be generated by the first pair C-1 of load cells and the second pair C-2 of load cells (thus not processing any of the respective electrical signals which can be generated by the third pair C-3 of load cells) or based on the data representative of the local force vectors detected by the second force plate P2 identifiable by processing only respective electrical signals which can be generated by the second pair C-2 of load cells and the third pair C-3 of load cells (thus not processing any of the respective electrical signals which can be generated by the first pair C-1 of load cells).

The first force plate P1 and the second force plate P2 are diagrammatically shown in FIGS. 6*a* and 6*b*.

According to an embodiment, in combination with the preceding one, the data processing unit 30 is configured to select the first force plate P1 identifiable by processing only respective electrical signals which can be generated by the first pair C-1 of load cells and the second pair C-2 of load cells (thus not processing any of the respective electrical signals which can be generated by the third pair C-3 of load cells) or a second force plate P2 identifiable by processing respective electrical signals generated by the second pair C-2 of load cells and the third pair C-3 of load cells or the second force plate P2 to determine the coordinate x of the resulting force vector F-R, based on a first orientation or a second orientation, opposite to the first orientation, of the local force vectors detected by the first pair C-1 of load cells and/or the third pair C-3 of load cells along the direction orthogonal to the portion PZ of the surface of physical exercise 10.

The first orientation and second orientation were defined above.

According to an embodiment, in combination with any of the preceding ones in which the third pair C-3 of load cells is present, when the selection can be made based on the data representative of local force vectors taken from the first pair C-1 of load cells alone:

- if the first pair C-1 of load cells detects local force vectors with the first orientation, defined above as negative, the data processing unit 30 is configured to select the second force plate P2; as defined above, the load cell works "under tension", the local force vector is a negative constraint reaction, and the generated electrical signal (electrical voltage) is negative;
- if the first pair C-1 of load cells detects local force vectors in the second orientation, defined above as positive, opposite to the first orientation, the data processing unit 30 unit is configured to select the first force plate P1.

As defined above, the load cell works "under compression", the local force vector is a positive constraint reaction, and the generated electrical signal (electrical voltage) is positive.

According to a further embodiment, in combination with any of the preceding ones, in which the third pair C-3 of load cells is present (i.e., it is possible to select either the first force plate P1 or the second force plate P2), when the selection can be made based on the data representative of local force vectors detected by only the third pair C-3 of load cells:

- if the third pair C-3 of load cells detects local force vectors in the second orientation ("positive"), the data processing unit 30 is configured to select the second force plate P2;
- if the third pair C-3 of load cells detects local force vectors in the first orientation ("negative"), the data processing unit 30 is configured to select the first force plate P1.

According to a further embodiment, in combination with any of the preceding ones, in which the third pair C-3 of load cells is present (i.e., it is possible to select either the first force plate P1 or the second force plate P2), when the selection can be made based on the data representative of local force vectors detected by the first pair C-1 of load cells and by the third pair C-3 of load cells:

- if the first pair C-1 of load cells detects local force vectors in the second orientation ("positive") and the third pair C-3 of load cells detects local force vectors in the first orientation ("negative"), the data processing unit 30 is configured to select the first force plate P1;
- if the first pair C-1 of load cells detects local force vectors in the first orientation and the third pair C-3 of load cells detects local force vectors in the second orientation ("positive"), the data processing unit 30 is configured to select the second force plate P2;
- if the first pair C-1 of load cells detects local force vectors in the second orientation ("positive") and the third pair C-3 of load cells detects local force vectors in the second orientation ("positive"), the data processing unit 30 is configured not to select any of the first force plate P1 and the second force plate P2.

It should be noted that the situation described with reference to the latter embodiment relates to an extreme case in which, when the user U is walking on the portion PZ of the surface of physical exercise 10, one foot is on the first plate P1 and the other foot is on the second plate P2.

In this case, the data processing unit 30 is configured not to select any of the first force plate P1 and the second force plate P2, considering the transient situation (hyperstatic system).

According to an embodiment, in combination with any of the preceding ones in which the determination of the coordinate x of the resulting force vector F-R is provided and the third pair C-3 of load cells is present, as an alternative to those in which the first force plate P1 and the second force plate P2 are selectable based on the first orientation or the second orientation of the local force vectors detected by the first pair C-1 of load cells and/or the third pair C-3 of load cells along the direction orthogonal to the portion PZ of the surface of physical exercise 10, the data processing unit 30 is configured to:

determine the sum of the magnitudes of the local force vectors detected by the first pair C-1 of load cells;

determine the sum of the magnitudes of the local force vectors detected by the third pair C-3 of load cells; and select the first force plate P1 or the second force plate P2 based on the comparison of the sum of the magnitudes of local force vectors detected by the first pair C-1 of load cells and the sum of the magnitudes of local force vectors detected by the third pair C-3 of load cells.

If the sum of the magnitudes of the local force vectors detected by the first C-1 pair of load cells is greater than the sum of the magnitudes of the local force vectors detected by the third pair C-3 of load cells, the data processing unit 30 is configured to select the first force plate P1.

If the sum of the magnitudes of the local force vectors detected by the first C-1 pair of load cells is lower than the sum of the magnitudes of the local force vectors detected by the third pair C-3 of load cells, the data processing unit 30 is configured to select the second force plate P2.

According to an embodiment, in combination with any of the preceding ones, such information representative of the resulting force vector F-R comprises at least one coordinate y of the resulting force vector F-R in a reference coordinate system S-R in which the coordinate y lies on an axis y of the reference coordinate system S-R transverse to the direction of longitudinal development D of the base 1 of the treadmill 100 and in which the coordinate y lies on the portion PZ of the surface of physical exercise 10.

In this embodiment, in determining the information representative of the resulting force vector F-R based on the data representative of the local force vectors detected by the plurality P-C of load cells, the data processing unit 30 is configured to determine the coordinate y of the resulting force vector F-R.

As mentioned above, the coordinate y of the resulting force vector F-R represents the position of the point of application of the resulting force vector F-R on the portion PZ of the surface of physical exercise 10 transversally to the direction of longitudinal development D of the base 1 of the treadmill 100.

According to an embodiment, in combination with any of the preceding ones in which the determination of the coordinate y of the resulting force F-R, and in which the plurality P-C of load cells, along the direction of development D of the base 1 of the treadmill 100, comprises only the first pair C-1 of load cells and the second pair C-2 of load cells, the data processing unit 30 is configured to determine the coordinate y of the resulting force vector F-R based on the data representative of the local force vectors detected by the first pair C-1 of load cells and the second pair C-2 of load cells.

For example, the data processing unit 30 is configured to determine the coordinate y of the resulting force vector F-R based on the proportion between a first sum of the magnitudes of the local force vectors detected by each first load cell C-11, C-21 of the first pair C-1 of load cell and the second pair C-2 of load cells, respectively, and a second sum of the magnitudes of the local force vectors detected by each second load cell C-12, C-22 of the first pair C-1 of load cells and the second pair C-2 of load cells, respectively.

According to an embodiment, in combination with the preceding one in which the third pair C-3 of load cells is provided, the data processing unit 30 is configured to determine the coordinate y of the resulting force vector F-R based on the data representative of the local force vectors detected by the first C-1 pair of load cells, the second pair C-2 of load cells, and the third pair C-3 of load cells.

For example, the data processing unit 30 is configured to determine the coordinate y of the resulting force vector F-R based on the proportion between a first sum of the magnitudes of the local force vectors detected by each first load cell C-11, C-21 and C-31 of the first pair C-1 of load cells, the second pair C-2 of load cells and the third pair C-3 of load cells, respectively, and a second sum of the magnitudes of the local force vectors detected by each second load cell C-12, C-22 and C-32 of the first pair C-1 of load cells, the second pair C-2 of load cells and the third pair C-3 of load cells, respectively.

In both embodiments just described, depending on the proportion between the first sum and the second sum, the coordinate y of the resulting force vector F-R, transverse to the direction of longitudinal development D of the base 1 of the treadmill 100, will be more shifted toward the first side of the surface of physical exercise 10 (first sum greater than the second sum) or the second side of the surface of physical exercise 10 (first sum less than the second sum).

In the particular case in which the first sum is substantially equal to the second sum, the coordinate y of the resulting force vector F-R, transverse to the direction of longitudinal development D of the base 1 of the treadmill 100, will be substantially equidistant from the first side of the surface of physical exercise 10 and the second side of the surface of physical exercise 10.

According to an embodiment, in combination with any of the preceding ones, such information representative of the resulting force vector F-R comprises a magnitude value of the resulting force vector F-R along the direction orthogonal to the portion PZ of the surface of physical exercise 10.

The direction orthogonal to the portion PZ of the surface of physical exercise 10 is parallel to an axis z of the reference coordinate system S-R orthogonal to the portion PZ of the surface of physical exercise 10.

In this embodiment, in determining the information representative of the resulting force vector F-R based on the data representative of the local force vectors detected by the plurality P-C of load cells, the data processing unit 30 is configured to determine the magnitude value of the resulting force vector F-R due to the interaction of a user U with a surface of physical exercise 10 of a treadmill 100 along a direction orthogonal to the portion PZ of the surface of physical exercise 10 (defined above).

The magnitude value of the resulting force vector F-R along the direction orthogonal to the portion PZ of the surface of physical exercise 10 is representative of the intensity or amplitude of the force applied, in the direction orthogonal to the portion PZ of the surface of physical exercise 10, by the surface of physical exercise 10 on the user U.

According to an embodiment, in combination with any of the preceding ones described above, for each sampling time instant $t_i$, with $1<i<N$, of the plurality of subsequent sampling time instants $t_1, t_2, \ldots, t_N$, with positive integer N, the data processing unit 30 is configured to receive the information representative of a speed value of forward movement of the surface of physical exercise 10.

In greater detail, the data processing unit 30 is configured to receive the information representative of a speed value of forward movement of the surface of physical exercise 10 from a speed sensor (not shown in the figures) with which the treadmill 100 is provided.

Such a speed sensor, for example operatively connected to an actuation unit (e.g., an electric motor, not shown in the figures) of the surface of physical exercise 10, for each sampling time instant $t_i$, with $1<i<N$, of the plurality of subsequent sampling time instants $t_1, t_2, \ldots, t_N$, with positive integer N, is configured to detect the speed value of forward movement of the surface of physical exercise 10 and send such information to the data processing unit 30.

In an embodiment, in combination with the preceding one in which the data processing unit 30 is configured to receive the information representative of a speed value of forward movement of the surface of physical exercise 10, in the presence of a forward movement of the surface of physical exercise 10 (speed value of forward movement of the surface of physical exercise 10 greater than zero), the data processing unit 30 of the treadmill 100 is configured to determine information representative of the user's U postural and locomotor stance.

In greater detail, the data processing unit 30 is configured to determine the information representative of the user's postural and locomotor stance based on one or more of the coordinate x, the coordinate y, the magnitude value of the resulting force vector F-R, the direction orthogonal to the portion PZ of the surface of physical exercise 10 and the direction of the resulting force vector F-R.

In an embodiment, in combination with any of the preceding ones in which the data processing unit 30 is configured to receive the information representative of a speed value of forward movement of the surface of physical exercise 10, in the presence of a forward movement of the surface of physical exercise 10 (speed value of forward movement of the surface of physical exercise 10 greater than zero), the data processing unit 30 is configured to determine information on the locomotion strategy (gait analysis) of the user U.

In greater detail, the information on the locomotion strategy of the user U (gait analysis) comprises:

- spatial-temporal and/or biomechanical information on the walk (described in detail below as information representative of the user's walk); and
- spatial-temporal and/or biomechanical information on the run (described in detail below as information representative of the user's run).

In an embodiment, in combination with any of the preceding ones in which the data processing unit 30 is configured to receive the information representative of a speed value of forward movement of the surface of physical exercise 10, the data processing unit 30, in the presence of a forward movement of the surface of physical exercise 10 (speed value of forward movement of the surface of physical exercise is greater than zero), is configured to compensate for the coordinate x of the resulting force vector F-R determined at the sampling time instant $t_i$ as a function of the forward movement of the surface of physical exercise 10 due to the detected speed value of forward movement of the surface of physical exercise 10 and a time difference between two subsequent sampling time instants $\Delta t$.

In an embodiment, in combination with the preceding one, the data processing unit 30 is configured to determine the coordinate x of the resulting force vector F-R compensated for at the sampling time instant $t_i$ as a function of the coordinate x of the resulting force vector F-R determined at the sampling time instant $t_i$, of the detected speed value of forward movement of the surface of physical exercise 10, and the time difference $\Delta t$ between two subsequent sampling time instants.

According to an embodiment, in combination with any of the preceding ones in which the data processing unit 30 is configured to receive the information representative of a speed value of forward movement of the surface of physical exercise 10, the data processing unit 30, in the presence of a forward movement of the surface of physical exercise 10 (speed value of forward movement of the surface of physical exercise is greater than zero), is configured to determine, when the user U is walking on the surface of physical exercise 10, mutually in combination or alternatively, one or more pieces of information representative of the walk of the user U by analyzing the trend, in a plurality of sampling time instants, of one or more of the coordinate x, the coordinate y and the magnitude value of the resulting force vector F-R determined in the plurality of sampling time instants.

The one or more pieces of information representative of the walk of the user U comprise at least one of:

- pace of the user U;
- stride length (which can be determined by the data processing unit 30 once it has received the information representative of the speed value of forward movement of the surface of physical exercise 10);
- contact time of a foot on the surface of physical exercise 10;
- swing time of a foot (i.e., the time elapsing between the lifting of the foot and the next placement of the same foot, following the swinging movement of the leg);
- amount of swinging movement of each leg;
- "loading response", i.e., the response of the user U from the time instant in which the contact of a foot with the surface of physical exercise 10 occurs to the time instant in which the maximum load is on the same foot;
- loading during the pushing, i.e., the phase between maximum loading on one foot ("midstance") and the lifting of the same foot from the surface of physical exercise 10 ("toe-off");
- biomechanical information representative of the latero-lateral and antero-posterior displacement of the center of pressure of the user U;
- biomechanical information representative of any asymmetry in the walk of the user U;
- biomechanical information representative of the amplitude of the generated forces;
- biomechanical information representative of changes in the amplitude of the generated forces;
- biomechanical information indicative of the user's fatigue state (e.g., amount of the mid-lateral oscillations, along the second coordinate y, and/or antero-posterior oscillations, along the coordinate x of the resulting force vector F-R, and changes in the force magnitude also by means of frequency spectrum analysis).

According to an embodiment, in combination with any of the preceding ones described above in which the data processing unit 30 is configured to receive the information representative of a speed value of forward movement of the surface of physical exercise 10, the data processing unit 30, in the presence of a forward movement of the surface of physical exercise 10 (speed value of forward movement of the surface of physical exercise is greater than zero), is configured to determine, when the user U is running on the surface of physical exercise 10, mutually in combination or alternatively, one or more pieces of information representative of the run of the user U by analyzing the trend, for a plurality of sampling time instants, of one or more of the coordinate x, the coordinate y and the magnitude value of the resulting force vector F-R determined in the plurality of sampling time instants.

The one or more pieces of information representative of the run of the user U comprise at least one of:

- pace of user U;
- stride length (which can be determined by the data processing unit 30 once it has received the information representative of the speed value of forward movement of the surface of physical exercise 10);
- contact time of a foot on the exercise surface 10;
- flight time;
- "loading response", i.e., the response of the user U from the time instant in which the contact of a foot with the surface of physical exercise 10 occurs to the time instant in which the maximum load is on the same foot;
- loading during the pushing, i.e., the phase between maximum loading on one foot ("midstance") and the lifting of the same foot from the surface of exercise ("toe-off");
- biomechanical information representative of the latero-lateral and antero-posterior displacement of the center of pressure of the user U;
- biomechanical information representative of any asymmetry in the run of the user U;
- biomechanical information representative of the intensity or amplitude of the generated forces;
- biomechanical information representative of changes in the intensity or amplitude of the generated forces.
- biomechanical information indicative of the user's fatigue state (e.g., amount of the mid-lateral oscillations, along the second coordinate y, and/or antero-posterior oscillations, along the coordinate x of the resulting force vector F-R, and changes in the force magnitude also by means of frequency spectrum analysis).

In other words, the analysis by the data processing unit 30, in the presence of a forward movement of the surface of physical exercise 10 (speed value of forward movement surface of physical exercise greater than zero), of the trend, in a plurality of sampling time instants, of the coordinate x, the coordinate y and/or the magnitude value of the resulting force vector F-R determined in the plurality of sampling time instants, advantageously allows obtaining biomechanical information representative of the walk and run of user U.

According to an embodiment, in combination with any of the those described above in which the data processing unit 30 is configured to receive the information representative of a speed value of forward movement of the surface of physical exercise 10, in the absence of surface of physical exercise 10 forward (surface of physical exercise speed value of forward movement of zero), the data processing unit 30 is configured to determine information on to the orthostatic stance of the user U.

For example, the data processing unit 30 is configured to determine information representative of any asymmetry of the stationary position of the user U by analyzing the trend, in a plurality of sampling time instants, of one or more of the coordinate x, the coordinate y, and the magnitude value of the resulting force vector F-R determined in the plurality of sampling time instants.

In greater detail, in the particular case in which the trend of the coordinate x and the coordinate y is simultaneously analyzed, the trend of the position of the center of pressure of the user U is analyzed.

The information representative of any asymmetry of the stationary position of user U represents the orthostatic symmetry of user U, which allows evaluating the balance ability of the user U.

In greater detail, the data processing unit 30 is configured to determine such a symmetry/asymmetry by calculating a statistical value of the distribution of the coordinate x and/or coordinate y values, respectively, in a set time interval.

For example, such a statistical value can be the median and/or the mean and/or the standard deviation of the values of the coordinate x and coordinate y, respectively, in the set time interval.

The mean values of the coordinate x and the coordinate y in the set time interval, together with those of standard deviation, are "stability and balance" indicators of the user U.

Graphically speaking, the coordinate x, the coordinate y and the magnitude value of the resulting force vector F-R can be represented by means of:

- Cartesian time charts, e.g., "butterfly chart", time series, and so on;
- point values with related statistical indices (deviation, mean, and so on).

For example, when the user U walks on the surface of physical exercise, based on the coordinate x and the coordinate y of the resulting force vector F-R determined in a set time interval by data processing unit 30, a so-called butterfly chart can be determined.

Moreover, when the user U runs on surface of physical exercise 10, based on the coordinate x and second coordinate y of the resulting force vector F-R determined in a set time interval by the data processing unit 30 it is possible to determine a graphical depiction representative of the displacement of the center of pressure (center of mass) of the user U under the body of the user U during the step of running.

In addition, when the user U walks or runs on the surface of physical exercise 10, based on the trend of the magnitude value of the resulting force vector F-R (orthogonal component to the portion PZ of the surface of physical exercise 10 of the ground reaction force GRF) in a set time interval, the data processing unit 30 is configured to determine representative events of:

- moment of foot contact with the surface of physical exercise ("heelstrike") while walking or running;
- moment of maximum loading on one foot ("midstance") while walking or running;
- moment of detachment of the foot from the surface of physical exercise 10 ("toe-off") while walking or running.

According to an embodiment, in combination with any of the preceding ones, the data processing unit 30 is configured to store in a memory module the determined information representative of the resulting force vector F-R due to the interaction of the user U with the surface of physical exercise 10 of the treadmill 100 (coordinate x and/or coordinate y and/or magnitude value of the resulting force vector F-R along the direction orthogonal to the portion PZ of the surface of physical exercise 10 associated with the sampling time instant $t_i$).

It should be noted that this storage is preferably performed by the data processing unit 30 at each sampling time instant $t_i$.

According to an embodiment, in combination with the preceding ones when the data processing unit 30 is configured to receive the information representative of a speed value of forward movement of the surface of physical exercise 10, the data processing unit 30 is configured to store in the storage module the received information representative of a speed value of forward movement of the surface of physical exercise, the determined information on the orthostatic stance of the user U, the determined information representative of the postural and locomotor stance of the user U, the determined information on the locomotion strategy of the user U (gait analysis), the one or more determined pieces of information representative of the walk of the user U, the one or more pieces of information representative of the running technique of the user U.

It should be noted also that this storage is preferably performed by the data processing unit 30 at each sampling time instant $t_i$.

According to an embodiment, in combination with the preceding one in which storage in the memory module is provided, the memory module is the memory unit 31 of the treadmill 100 or an additional memory unit 40 of an electronic apparatus 41 (diagrammatically shown with dashed lines in FIG. 8) remote with respect to the treadmill 100 and in communication with the data processing unit 30.

Examples of electronic apparatus 41 are a cloud server processor, a tablet-type electronic device, a smartphone, a notebook, a personal computer, and so on.

A method 600 for determining information representative of the interaction of a user U with a surface of physical exercise 10 of a treadmill 100, hereinafter also only method for determining or simply method, according to the present invention, will be described with reference to also FIG. 9.

The treadmill 100 has already been described above according to the present invention and further embodiments, therefore the description thereof will not be repeated again for brevity purposes.

The method 600 comprises a symbolic step of starting ST.

The method 600, for each sampling time instant $t_i$, with $1<i<N$, of a plurality of subsequent sampling time instants $t_1, t_2, \ldots, t_N$, with positive integer N, comprises the following steps.

The method 600 comprises a step of detecting 601, by each load cell of said plurality P-C of load cells of the treadmill 100, data representative of a respective local force vector F-11, F-12, F-21, F-22 (F-31, F-32) along a direction orthogonal to a portion PZ of the surface of physical exercise 10 of the treadmill 100 at such a load cell and due to the interaction of the user U with the surface of physical exercise 10.

The "data representative of a local force vector" were defined above.

The method 600 further comprises a step of determining 602, by the data processing unit 30 of the treadmill 100, information representative of a resulting force F-R due to an interaction of the user U with the surface of physical exercise 10 of the treadmill 100 based on the data representative of the local force vectors detected by the plurality P-C of load cells.

In particular, as described below with reference to different embodiments, the data processing unit 30 determines the information representative of a resulting force vector F-R based on the data representative of local force vectors detected by one or both the load cells of one or more of said first pair of load cells C-1, second pair C-2 of load cells, and, if present, third pair C-3 of load cells of the plurality P-C load cells.

The resulting force vector F-R was defined above.

The method 600 comprises a symbolic step of ending ED.

Figure 9:
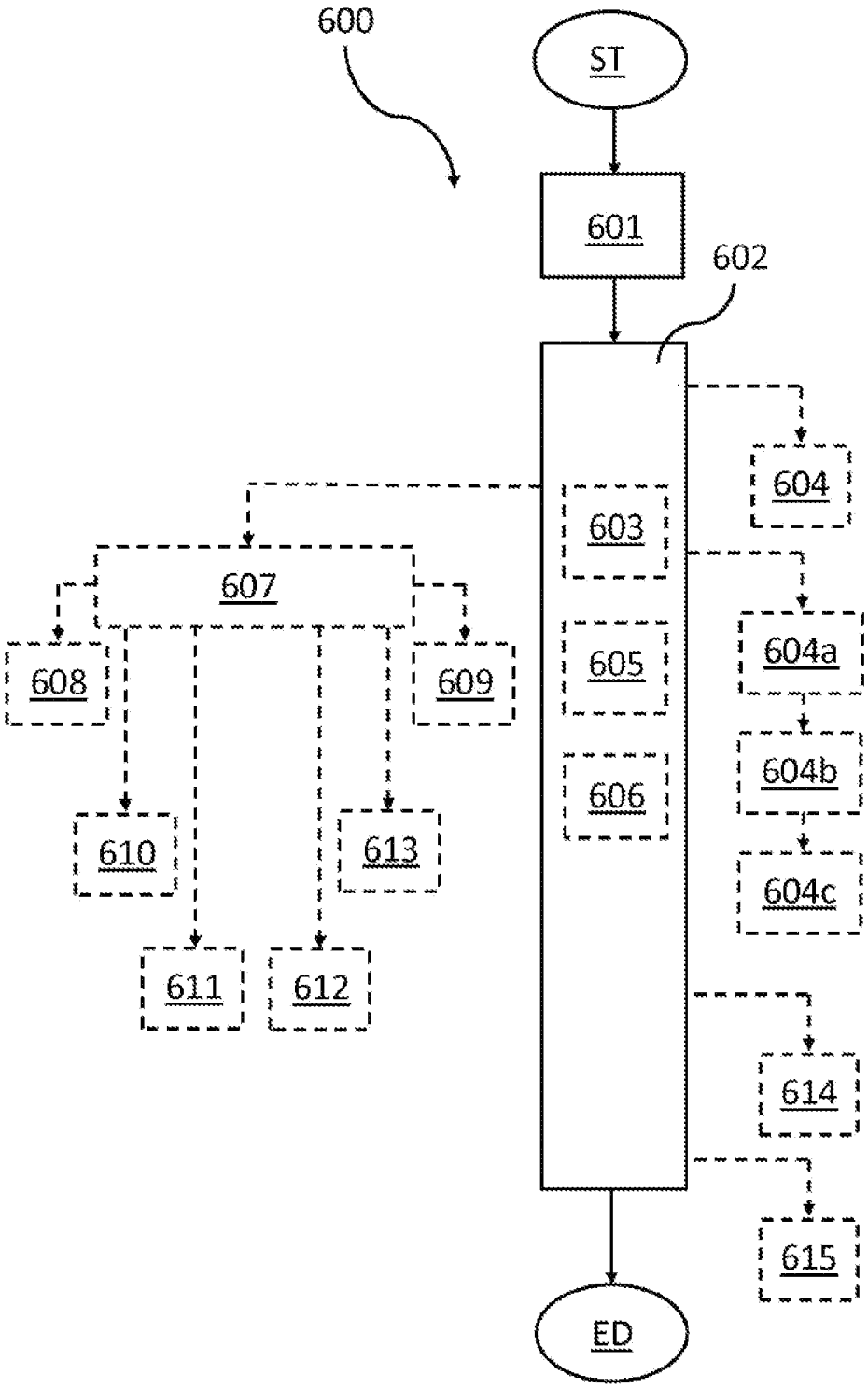

According to an embodiment, shown with dashed lines in FIG. 9, the information representative of the resulting force vector F-R comprises at least one coordinate x of the resulting force vector F-R in a reference coordinate system S-R in which the coordinate x lies on an axis x of the reference coordinate system S-R parallel to the direction of longitudinal development D of the base of the treadmill 100 and in which the coordinate x lies on the portion PZ of the surface of physical exercise 10.

In this embodiment, the step of determining 602 information representative of the resulting force vector F-R based on the data representative of the local force vectors detected by the plurality P-C of load cells comprises at step of determining 603, by the data processing unit 30, the coordinate x of the resulting force vector F-R.

The coordinate x of the resulting force vector F-R represents the position of the point of application of the resulting force vector F-R on the portion PZ of the exercise surface 10 along the direction of longitudinal development D of the base of the treadmill 100.

According to an embodiment, in combination with the preceding one in which the determination of the coordinate x of the resulting force vector F-R is provided, and only the first pair C-1 of load cells and the second pair C-2 of load cells are present, the coordinate x of the resulting force vector F-R is determined, by the data processing unit 30, based on the data representative of the local force vectors detected by the first force plate P1 identifiable by processing respective electrical signals which can be generated by the first pair C-1 of load cells and the second pair C-2 of load cells.

According to an embodiment, in combination with any of the preceding ones in which the determination of the coordinate x of the resulting force vector F-R is provided and the third pair C-3 of load cells is also present, the coordinate x of the resulting force vector F-R is determined, by the data processing unit 30, based on the data representative of the local force vectors detected by the first force plate P1 identifiable by processing only respective electrical signals which can be generated by the first pair C-1 of load cells and the second pair C-2 of load cells (thus not processing any of the respective electrical signals which can be generated by the third pair C-3 of load cells) or based on the data representative of the local force vectors detected by the second force plate P2 identifiable by processing respective electrical signals which can be generated by the second pair C-2 of load cells and the third pair C-3 of load cells (thus not processing any of the respective electrical signals which can be generated by the first pair C-1 of load cells).

According to an embodiment, in combination with the preceding ones and shown by dashed lines in FIG. 9, the methods 600 comprises a step of selecting 604, by the data processing unit 30, the first force plate P1 identifiable by processing only respective electrical signals generated by a first pair C-1 of load cells and by a second pair C-2 of load cells (thus not processing any one of the respective electrical signals which can be generated by a third pair C-3 of load cells) or a second force plate P2 identifiable by processing respective electrical signals generated by the second pair C-2 of load cells and by a third pair C-3 of load cells (thus by not processing any one of the respective electrical signals which can be generated by the first pair C-1 of load cells) in order to determine the coordinate x of the resulting force vector F-R, based on a first orientation or on a second orientation, opposite to the first orientation, of the local force vectors detected by the first pair C-1 of load cells and/or by the third pair C-3 of load cells along the direction orthogonal to the portion PZ of the surface of physical exercise 10.

The first orientation and second orientation of the resulting force vector F-R were defined above.

According to an embodiment, in combination with any of the preceding ones in which the third pair C-3 of load cells is present, when the selection can be made based on the data representative of local force vectors taken from the first pair C-1 of load cells alone:

- if the first pair C-1 of load cells detects local force vectors in the first orientation ("negative"), the data processing unit 30 selects the second force plate P2;
- if the first pair C-1 of load cells detects local force vectors in the second orientation ("positive"), opposite to the first orientation, the data processing unit 30 selects the first force plate P1.

According to an embodiment, in combination with any of the preceding ones, in which the third pair C-3 of load cells is present (i.e., it is possible to select either the first force plate P1 or the second force plate P2), when the selection can be made based on the data representative of local force vectors detected by only the third pair C-3 of load cells:

- if the third pair C-3 of load cells detects local force vectors in the second orientation ("positive"), the data processing unit 30 selects the second force plate P2;
- if the third pair C-3 of load cells detects local force vectors in the first orientation ("negative"), the data processing unit 30 selects the first force plate P1.

According to an embodiment, in combination with any of the preceding ones, in which the third pair C-3 of load cells is present (i.e., it is possible to select either the first force plate P1 or the second force plate P2), when the selection can be made based on the data representative of local force vectors detected by the first pair C-1 of load cells and by the third pair C-3 of load cells:

- if the first pair C-1 of load cells detects local force vectors in the second orientation and the third pair C-3 of load cells detects local force vectors in the first orientation, the data processing unit 30 selects the first force plate P1;
- if the first pair C-1 of load cells detects local force vectors in the first orientation and the third pair C-3 of load cells detects local force vectors in the second orientation, the data processing unit 30 selects the second force plate P2;
- if the first pair C-1 of load cells detects local force vectors in the second orientation ("positive") and the third pair C-3 of load cells detects local force vectors in the second orientation, the data processing unit 30 does not select any of the first force plate P1 and the second force plate P2.

According to an embodiment, shown with dashed lines in FIG. 9, in combination with any of the preceding ones in which the determination of the coordinate x of the resulting force vector F-R is provided and the third pair C-3 of load cells is present, alternative to those in which the first force plate P1 and the second force plate P2 can be selected based on the first orientation or the second orientation of the local force vectors detected by the first pair C-1 of load cells and/or the third pair C-3 of load cells along the direction orthogonal to the portion PZ of the surface of physical exercise 10, the method 600 comprises steps of:

- determining 604*a*, by the data processing unit 30, the sum of the magnitudes of the local force vectors detected by the first pair C-1 of load cells;
- determining 604*b*, by the data processing unit 30, the sum of the magnitudes of the local force vectors detected by the third pair C-3 of load cells;
- selecting 604*c*, by the data processing unit 30, the first force plate P1 or the second force plate P2 based on the comparison of the sum of the magnitudes of local force vectors detected by the first pair C-1 of load cells and the sum of the magnitudes of local force vectors detected by the third pair C-3 of load cells.

If the sum of the magnitudes of the local force vectors detected by the first C-1 pair of load cells is greater than the sum of the magnitudes of the local force vectors detected by the third pair C-3 of load cells, the data processing unit 30 selects the first force plate P1.

If the sum of the magnitudes of the local force vectors detected by the first C-1 pair of load cells is lower than the sum of the magnitudes of the local force vectors detected by the third pair C-3 of load cells, the data processing unit 30 selects the second force plate P2.

According to an embodiment, shown with dashed lines in FIG. 9, in combination with any of the preceding ones, said information representative of the resulting force vector F-R comprise at least one coordinate y of the resulting force vector F-R in a reference coordinate system S-R in which the coordinate y lies on an axis y of the reference coordinate system S-R parallel to the direction of longitudinal development D of the base 1 of the treadmill 100 and in which the coordinate y lies on the portion PZ of the surface of physical exercise 10.

In this embodiment, the step of determining 602 information representative of the resulting force vector F-R based on the data representative of the local force vectors detected by the plurality P-C of load cells comprises at step of determining 605, by the data processing unit 30, the first y coordinate of the resulting force vector F-R.

The coordinate y of the resulting force vector F-R represents the position of the point of application of the resulting force vector F-R on the portion PZ of the surface of physical exercise 10 transversally to the direction of longitudinal development D of the base 1 of the treadmill 100.

According to an embodiment, in combination with any of the preceding ones in which the determination of the coordinate y of the resulting force F-R, and wherein the plurality P-C of load cells, along the direction of development D of the base 1 of the treadmill 100, comprises only the first pair C-1 of load cells and the second pair C-2 of load cells, the coordinate y of the resulting force vector F-R is determined, by the data processing unit 30, based on the data representative of the local force vectors detected by the first pair C-1 of load cells and by the second pair of load cells C-2.

For example, the data processing unit 30 determines the coordinate y of the resulting force vector F-R based on the proportion between a first sum of the magnitudes of the local force vectors detected by each first load cell pair C-11, C-21 respectively of the first pair C-1 of load cells of the second pair C-2 of load cells and a second sum of the magnitudes of the local force vectors detected by each second load cell pair C-12, C-22 respectively of the first pair C-1 of load cells of the second pair C-2 of load cells.

According to an embodiment, in combination with the preceding one in which the third pair C-3 of load cells is provided, the coordinate y of the resulting force vector F-R is determined, by the data processing unit 30, based on the data representative of the local force vectors detected by the first pair C-1 of load cells, by the second pair C-2 of load cells and by the third pair C-3 of load cells.

For example, the data processing unit 30 determines the coordinate y of the resulting force vector F-R based on the proportion between a first sum of the magnitudes of the local force vectors detected by each first load cell pair C-11, C-21, and C-31 respectively of the first pair C-1 of load cells of the second pair C-2 of load cells and the third pair C-3 of load cells, and a second sum of the magnitudes of the local force vectors detected by each second pair of load cells C-12, C-22, and C-32 respectively of the first pair C-1 of load cells, the second pair C-2 of load cells and the third pair C-3 of load cells.

In both embodiments just described, depending on the proportion between the first sum and the second sum, the coordinate y of the resulting force vector F-R, transverse to the direction of longitudinal development D of the base 1 of the treadmill 100, will be more shifted toward the first side of the surface of physical exercise 10 (first sum greater than the second sum) or the second side of the surface of physical exercise 10 (first sum less than the second sum).

In the particular case in which the first sum is substantially equal to the second sum, the coordinate y of the resulting force vector F-R, transverse to the direction of longitudinal development D of the base 1 of the treadmill 100, will be substantially equidistant from the first side of the surface of physical exercise 10 and the second side of the surface of physical exercise 10.

According to an embodiment, shown with dashed lines in FIG. 9, in combination with any of the preceding ones, the information representative of the resulting force vector F-R comprises a magnitude value of the resulting force vector F-R along the direction orthogonal to the portion PZ of the surface of physical exercise 10.

The direction orthogonal to the portion PZ of the surface of physical exercise 10 is parallel to an axis z of the reference coordinate system S-R orthogonal to the portion PZ of the surface of physical exercise 10.

In this embodiment, the step of determining 602 information representative of the resulting force vector F-R based on the data representative of the local force vectors detected by the plurality P-C of load cells comprising at step of determining 606, by the data processing unit 30, a value of the resulting force vector F-R along the direction orthogonal to the portion PZ of the surface of physical exercise 10.

The magnitude value of the resulting force vector F-R along the direction orthogonal to the portion PZ of the surface of physical exercise 10 is representative of the intensity or amplitude of the force applied, in the direction orthogonal to the portion PZ of the surface of physical exercise 10, by the surface of physical exercise 10 on the user U.

According to an embodiment, in combination with any of the preceding ones and shown with dashed lines in FIG. 9, the method 600 comprises a step of detecting 607, by the data processing unit 30, a speed value of forward movement of the surface of physical exercise 10.

In an embodiment, in combination with any of the preceding ones in which a speed value of forward movement of the surface of physical exercise 10 is detected and shown with dashed lines in FIG. 9, in the presence of a forward movement of the surface of physical exercise 10 (speed value of forward movement of the surface of physical exercise 10 greater than zero), the method 600 comprises a step of determining 608, by the data processing unit 30, information representative of the information representative of the postural and locomotor stance of the user U (defined above).

In greater detail, the information representative of the postural and locomotor stance of the user U is determined by the data processing unit 30, based on one or more of coordinate x, coordinate y, magnitude value of the resulting force vector F-R, direction orthogonal to the portion PZ of the surface of physical exercise 10, and direction of the resulting force vector F-R.

In an embodiment, in combination with any of the preceding ones in which a speed value of forward movement of the surface of physical exercise 10 is detected and shown with dashed lines in FIG. 9, in the presence of a forward movement of the surface of physical exercise 10 (speed value of forward movement of the surface of physical exercise 10 greater than zero), the method 600 comprises a step of determining 609, by data processing unit 30, information on the locomotion strategy of the user U (gait analysis) (some examples of which were defined above).

In an embodiment, in combination with any of the preceding ones in which a speed value of forward movement of the surface of physical exercise 10 is detected and shown with dashed lines in FIG. 9, the method 600, in the presence of a forward movement of the surface of physical exercise 10 (speed value of forward movement of the surface of physical exercise is greater than zero), comprises a step of compensating 610, by the data processing unit 30, the coordinate x of the resulting force vector F-R determined at the sampling time instant $t_i$ as a function of the forward movement of the surface of physical exercise 10 due to the detected speed value of forward movement of the surface of physical exercise 10 and a time difference between two subsequent sampling time instants $\Delta t$.

According to an embodiment, in combination with the preceding one, the coordinate x of the resulting vector F-R compensated for at the sampling time instant $t_i$ is determined by the data processing unit 30 as a function of the first x coordinate of the resulting vector F-R determined at the sampling time instant $t_i$, the detected speed value of forward movement of the surface of physical exercise 10 and the time difference $\Delta t$ between two subsequent sampling time instants.

According to an embodiment, in combination with any of the preceding ones in which a speed value of forward movement of the surface of physical exercise 10 is detected and shown with dashed lines in FIG. 9, the method 600, in the presence of a forward movement of the surface of physical exercise 10 (speed value of forward movement of the surface of physical exercise greater than zero), comprises a step of determining 611, by the data processing unit 30, when the user U is walking on the surface of physical exercise 10, mutually in combination or alternatively, one or more pieces of information representative of the walk of the user U by analyzing the trend, for a plurality of sampling time instants, of one or more of the coordinate x, the coordinate y and the magnitude value of the resulting force vector F-R determined in the plurality of sampling time instants.

The one or more pieces of information representative of the walk of the user U were described above.

According to an embodiment, in combination with any of the preceding ones in which the speed value of forward movement of the surface of physical exercise 10 is detected, the method 600, in the presence of a forward movement of the surface of physical exercise 10 (speed value of forward movement of the surface of physical exercise greater than zero), comprises a step of determining 612, by the data processing unit 30, when the user U is running on the surface of physical exercise 10, mutually in combination or alternatively, one or more pieces of information representative of the running technique of the user U by analyzing the trend, for a plurality of sampling time instants, of one or more of the coordinate x, the coordinate y and the magnitude value of the resulting force vector F-R determined in the plurality of sampling time instants.

The one or more pieces of information representative of the running technique of the user U were described above.

In an embodiment, in combination with any of the preceding ones in which a speed value of forward movement of the surface of physical exercise 10 is detected and shown with dashed lines in FIG. 9, in the absence of a forward movement of the surface of physical exercise 10 (speed value of forward movement of the surface of physical exercise equal to zero), the method 600 comprises a step of determining 613, by the data processing unit 30, information on the orthostatic stance of the user U (some examples of which were provided above).

According to second an embodiment, in combination with any of the preceding ones and shown with dashed lines in FIG. 9, the method 600 comprises a step of storing 614 in a memory module, by the data processing unit 30, the determined information representative of the resulting force vector F-R due to the interaction of the user U with the surface of physical exercise 10 of the treadmill 100 (coordinate x and/or coordinate y and/or magnitude value of the resulting force vector F-R along the direction orthogonal to the portion PZ of the surface of physical exercise 10 associated with the sampling time instant $t_i$).

It should be noted that the step of storing 614 is preferably performed by data processing unit 30 at each instant of sampling time $t_i$.

According to an embodiment and in combination with the preceding one when the speed value of forward movement of the surface of physical exercise 10 is detected and shown with dashed lines in FIG. 9, the method 600 comprises a step of storing 615 in the memory module by the data processing unit 30, the received information representative of a speed value of forward movement of the surface of physical exercise, the determined information on the orthostatic stance of the user U, the determined information representative of the postural and locomotor stance of the user U, the determined information on the locomotion strategy of the user U (gait analysis), the one or more determined pieces of information representative of the walk of the user U, the one or more pieces of information representative of the running technique of the user U.

It should be noted that the step of storing 615 is also preferably performed by data processing unit 30 at each instant of sampling time $t_i$.

According to an embodiment, in combination with any of the preceding ones in which storage in the memory module is provided, the memory module is the memory unit 31 of the treadmill 100 or an additional memory unit 40 of an electronic apparatus 41 remote from the treadmill 100 and in communication with the data processing unit 30 of the treadmill 100.

Examples of remote electronic apparatuses were indicated above.

An example of implementation by the treadmill 100 according to the present invention of the method for determining information representative of the interaction of a user U with a surface of physical exercise 10 of a treadmill 100 will be described with reference now to the aforesaid figures.

A user U walks on the surface of physical exercise 10 of the treadmill 100.

For each sampling time instant $t_i$, with $1<i<N$, of a plurality of subsequent sampling time instants, $t_1, t_2, \ldots, t_N$, with positive integer N:

- each load cell of the plurality P-C of load cells arranged below the surface of physical exercise 10 detects data representative of local force vectors F-11, F-12, F-21, F-22, F-31, F-32 at such a load cell due to the interaction of the user U with the of the surface of physical exercise 10;
- the data processing unit 30 of the treadmill 100 determines information representative of a resulting force vector F-R due to the interaction of a user U with the surface of physical exercise 10 of a treadmill 100 based on the data representative of the local force vectors detected by the plurality P-C of load cells.

In particular, the data processing unit 30 determines a coordinate x and a coordinate y of the resulting force vector F-R in a reference coordinate system S-R which represent the location of a point of application of the resulting force vector F-R.

The point of application of the resulting force vector F-R represents the position of the center of pressure of the user U on the portion PZ of the surface of physical exercise 10 while walking.

Moreover, the data processing unit 30 determines a magnitude value of the resulting force vector F-R along the direction orthogonal to the portion PZ of the surface of physical exercise 10 (parallel to an axis z of the reference coordinate system S-R) which represents the intensity or amplitude of the force applied, in the direction orthogonal to the portion PZ of the surface of physical exercise 10, by the surface of physical exercise 10 on the user U.

This information, determined in a set time interval by data processing unit 30, is used to determine representative charts of performance indices of the user U during a walk or from which distinct contact points of the toe, midfoot, heel, or toe thrust during the walk can be extracted to obtain biomechanical information about the user U.

As can be seen, the object of the invention is fully achieved.

Indeed, the treadmill of the present disclosure provides for a rather simple, minimally invasive installation of load cells (defining one or more force plates) which ensures both accuracy and reliability of the determinations to be made by the force plates.

Moreover, the treadmill according to the present invention has ease of assembly, ease of replacement of one or more load cells in case of failure, ease of replacement of supporting elements of the surface of physical exercise.

In addition, the treadmill of the present invention can be obtained from a treadmill with a pre-existing structure which can be equipped with the plurality of load cells without changing the pre-existing structure.

Moreover, in the embodiment in which the first force plate P1 and the second force plate P2 share a pair of cells (in particular, the second pair C-2 of load cells), it is advantageously possible to achieve the functionality of two separate force plates with a smaller number of load cells and a simpler system configuration.

Moreover, the method and the associated treadmill allow the determination of information representative of a resulting force vector due to the interaction of a user with a surface of physical exercise of a treadmill by achieving the right trade-off between the accuracy and reliability of the determinations which can be made and the complexity of the treadmill, thus ensuring reduced intervention times and low costs for treadmill configuration.

Additionally, being able to select one of the first force plate and the second force plate identifiable in the surface of physical exercise of the treadmill advantageously allows obtaining more accurate and reliable information representative of the user's interaction with the surface of physical exercise.

Those skilled in art may make changes and adaptations to the embodiments of the treadmill described above or can replace elements with others which are functionally equivalent in order to meet contingent needs without departing from the scope of the following claims. Each of the features described above as belonging to a possible embodiment can be implemented irrespective of the other embodiments described.

What is claimed is:

1. A treadmill comprising:

a base extending along a respective direction of longitudinal development, the base comprising a first rotating element and a second rotating element adapted to rotate around respective axes of rotation transverse to the direction of longitudinal development of the base of the treadmill, the base further comprising a surface of physical exercise operatively connected to the first rotating element and to the second rotating element, a rotation of the first rotating element and of the second rotating element dragging the surface of physical exercise by rotation along the direction of longitudinal development of the base of the treadmill, the surface of physical exercise having a respective portion facing towards a user during a user's interaction with the surface of physical exercise, the surface of physical exercise comprising a plurality of slats having respective directions of longitudinal development substantially parallel with respect to each other and transverse with respect to the direction of longitudinal development of the base of the treadmill;

a plurality of load cells arranged below the surface of physical exercise, each load cell of the plurality of load cells being arranged below the surface of physical exercise in such a way as to detect data representative of a local force vector along a direction orthogonal to the portion of the surface of physical exercise in correspondence of the load cell due to the user's interaction with the surface of physical exercise, the plurality of load cells including a first pair of load cells and a second pair of load cells arranged in series along the direction of longitudinal development of the base of the treadmill, the plurality of load cells being arranged, parallel to the direction of longitudinal development of the base of the treadmill, in correspondence of a first side of the surface of physical exercise and of a second side of the surface of physical exercise, wherein the first pair of load cells and the second pair of load cells are adapted to define a first force plate, wherein the plurality of load cells further comprises a third pair of load cells, the first pair of load cells, the second pair of load cells and the third pair of load cells being arranged in series along the direction of longitudinal development of the base of the treadmill, the third pair of load cells being arranged in such a way that, along the direction of longitudinal development of the base of the treadmill, the second pair of load cells is comprised between the first pair of load cells and the third pair of load cells, the second pair of load cells and the third pair of load cells being adapted to define a second force plate, the first force plate and the second force plate sharing a pair of cells, the treadmill further comprising a first supporting component of the surface of physical exercise and a second supporting component of the surface of physical exercise arranged on the first side of the surface of physical exercise and on the second side of the surface of physical exercise, respectively, parallel to the direction of longitudinal development of the base of the treadmill, the surface of physical exercise being mechanically connected to the first supporting component and to the second supporting component to slide along the direction of longitudinal development of the base of the treadmill, the plurality of load cells being arranged below the first supporting component of the surface of physical exercise and of the second supporting component of the surface of physical exercise.

2. The treadmill of claim 1, wherein the first supporting component of the surface of physical exercise comprises a first plurality of revolving elements and the second supporting component of the surface of physical exercise comprises a second plurality of revolving elements, each revolving element of said first plurality of revolving elements and of said second plurality of revolving elements being coupled to the respective supporting component in order to be freely rotating around a respective axis of rotation.

3. The treadmill of claim 1, wherein:

the first pair of load cells, transverse to the direction of longitudinal development of the base of the treadmill, comprises a first load cell arranged in correspondence of the first side of the surface of physical exercise and a second load cell arranged in correspondence of the second side of the surface of physical exercise; and the second pair of load cells, transverse to the direction of longitudinal development of the base of the treadmill, comprises a first load cell arranged in correspondence of the first side of the surface of physical exercise and a second load cell arranged in correspondence of the second side of the surface of physical exercise.

4. The treadmill of claim 3, wherein the first load cell and the respective second load cell of each pair of load cells are aligned with respect to each other transverse to the direction of longitudinal development of the base of the treadmill.

5. The treadmill of claim 1, wherein the third pair of load cells, transverse to the direction of longitudinal development of the base of the treadmill, comprises a first load cell arranged in correspondence of the first side of the surface of physical exercise and a second load cell arranged in correspondence of the second side of the surface of physical exercise.

6. The treadmill of claim 5, wherein the first load cell and the second load cell of the third pair of load cells are aligned with respect to each other transverse to the direction of longitudinal development of the base of the treadmill.

7. The treadmill of claim 1, wherein the surface of physical exercise comprises a plurality of slats having respective directions of longitudinal development substantially parallel with respect to each other and transversal with respect to the direction of longitudinal development of the base of the treadmill.

8. The treadmill of claim 1, further comprising a data processing unit operatively connected to the plurality of load cells, wherein for each sampling time instant ti, with 1<i<N, of a plurality of subsequent sampling time instants $t_1$, $t_2$, . . . , $t_N$, with positive integer N, each load cell of said plurality of load cells is configured to detect data representative of a respective local force vector along the direction orthogonal to the portion of the surface of physical exercise in correspondence of the load cell due to the user's interaction with the surface of physical exercise; and the data processing unit of the treadmill is configured to determine information representative of a resulting force vector due to the user's interaction with the surface of physical exercise of the treadmill based on the data representative of the local force vectors detected by the plurality of load cells.

9. The treadmill of claim 8, wherein said information representative of the resulting force vector comprises at least one coordinate x of the resulting force vector in a reference coordinate system wherein the coordinate x lies on an axis x of the reference coordinate system parallel to the direction of longitudinal development of the base of the treadmill and wherein the coordinate x lies on the portion of the surface of physical exercise, in determining the information representative of the resulting force vector based on the data representative of the local force vectors detected by the plurality of load cells, the data processing unit being configured to determine the coordinate x of the resulting force vector, the coordinate x of the resulting force vector representing a position of a point of application of the resulting force vector on the portion of the surface of physical exercise along the direction of longitudinal development of the base of the treadmill.

10. The treadmill of claim 9, wherein the data processing unit being configured to determine the coordinate x of the resulting force vector based on the data representative of the local force vectors detected by a first force plate determined by processing respective electrical signals generated by the first pair of load cells and by the second pair of load cells.

11. The treadmill of claim 9, wherein the data processing unit being configured to determine the coordinate x of the resulting force vector based on the data representative of the local force vectors detected by the first force plate determined by processing only respective electrical signals generated by the first pair of load cells and by the second pair of load cells or based on the data representative of the local force vectors detected by the second force plate determined by processing only respective electrical signals generated by the second pair of load cells and by the third pair of load cells.

12. The treadmill of claim 8, wherein said information representative of the resulting force vector comprises at least one coordinate y of the resulting force vector in a reference coordinate system wherein the coordinate y lies on an axis y of the reference coordinate system transverse to the direction of longitudinal development of the base of the treadmill and wherein the coordinate y lies on the portion of the surface of physical exercise, in determining the information representative of the resulting force vector based on the data representative of the local force vectors detected by the plurality of load cells, the data processing unit being configured to determine the coordinate y of the resulting force vector, the coordinate y of the resulting force vector representing a position of a point of application of the resulting force vector on the portion of the surface of physical exercise transverse to the direction of longitudinal development of the base of the treadmill.

13. The treadmill of claim 8, wherein said information representative of the resulting force vector comprises a magnitude value of the resulting force vector along the direction orthogonal to the portion of the surface of physical exercise, the direction orthogonal to the portion of the surface of physical exercise being parallel to a coordinate z of a reference coordinate system orthogonal to the portion of the surface of physical exercise, in determining the information representative of the resulting force vector based on the data representative of the local force vectors detected by the plurality of load cells, the data processing unit being configured to determine the magnitude value of the resulting force vector along the direction orthogonal to the portion of the surface of physical exercise, the magnitude value of the resulting force vector due to the user's interaction with the surface of physical exercise of the treadmill along the direction orthogonal to the portion of the surface of physical exercise, the magnitude value of the resulting force vector along the direction orthogonal to the portion of the surface of physical exercise being representative of an intensity or amplitude of a force exerted, in the direction orthogonal to the portion of the surface of physical exercise, by the surface of physical exercise on the user.

* * * * *